US011732875B2

(12) United States Patent
Ninomiya et al.

(10) Patent No.: US 11,732,875 B2
(45) Date of Patent: Aug. 22, 2023

(54) METHOD OF MOUNTING LIGHTING APPLIANCE, MOUNTING STRUCTURE FOR LIGHTING APPLIANCE, LIGHTING APPLIANCE, AND METHOD OF CONSTRUCTING BUILDING

(71) Applicant: NICHIA CORPORATION, Anan (JP)

(72) Inventors: Susumu Ninomiya, Niigata (JP); Tetsutoshi Ishida, Niigata (JP); Kei Haraguchi, Itano-gun (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 17/309,480

(22) PCT Filed: Nov. 15, 2019

(86) PCT No.: PCT/JP2019/044872
§ 371 (c)(1),
(2) Date: May 29, 2021

(87) PCT Pub. No.: WO2020/110777
PCT Pub. Date: Jun. 4, 2020

(65) Prior Publication Data

US 2022/0026049 A1 Jan. 27, 2022

(30) Foreign Application Priority Data

Nov. 30, 2018 (JP) ..... 2018-225201
Jun. 25, 2019 (JP) ..... 2019-117528
Jul. 31, 2019 (JP) ..... 2019-141711

(51) Int. Cl.
*F21S 8/02* (2006.01)
*F21V 21/03* (2006.01)
*F21V 23/06* (2006.01)

(52) U.S. Cl.
CPC ..... *F21V 21/03* (2013.01); *F21S 8/026* (2013.01); *F21V 23/06* (2013.01)

(58) Field of Classification Search
CPC ..... F21V 21/03; F21S 8/026
See application file for complete search history.

(56) References Cited

U.S. PATENT DOCUMENTS 8,882,308 B2 * 11/2014 Cho ..... F21V 21/04 362/364
9,791,111 B1 * 10/2017 Huang ..... F21V 23/005
(Continued)

FOREIGN PATENT DOCUMENTS

JP 2006070561 A 3/2006
JP 2009231016 A 10/2009
(Continued)

*Primary Examiner* — Evan P Dzierzynski
(74) *Attorney, Agent, or Firm* — Hunton Andrews Kurth LLP

(57) ABSTRACT

The present disclosure provides a method of mounting a lighting appliance that can be easily attached to a building material, a mounting structure for a lighting appliance, a lighting appliance, and a method of constructing a building. An electrical cable of a power supply unit disposed at a position that does not overlap a mounting hole on a rear side of a building material is passed through an inner opening of an annular mounting bracket, and a power supply side connector provided at an end portion of the electrical cable is positioned on a front side of the building material.
The power supply side connector is connected to a lighting appliance side connector fixed to an upper surface of a fitting adapter provided on a rear surface of a lighting appliance body on a side opposite to a light emitting surface.
The fitting adapter is fitted into the inner opening of the mounting bracket fitted into the mounting hole, and the upper surface of the fitting adapter is exposed to a space on a rear side of the building material.

11 Claims, 31 Drawing Sheets

(56) References Cited

U.S. PATENT DOCUMENTS

| | | | | |
|---|---|---|---|---|
| 10,584,858 | B1 * | 3/2020 | Boulanger | F21K 9/20 |
| 2008/0170398 | A1 * | 7/2008 | Kim | H01R 33/9453 315/210 |
| 2008/0232116 | A1 * | 9/2008 | Kim | F21V 29/83 362/365 |
| 2012/0044704 | A1 * | 2/2012 | Wilson | F21S 8/026 362/365 |
| 2016/0084491 | A1 * | 3/2016 | Boomgaarden | F21V 21/041 362/267 |
| 2016/0320007 | A1 * | 11/2016 | Araki | F21V 19/004 |
| 2017/0122534 | A1 * | 5/2017 | Ticktin | F21V 21/002 |
| 2020/0011512 | A1 * | 1/2020 | Chen | F21V 5/04 |

FOREIGN PATENT DOCUMENTS

| | | | |
|---|---|---|---|
| JP | 2009295544 | A | 12/2009 |
| JP | 2012248308 | A | 12/2012 |
| JP | 2015032467 | A | 2/2015 |
| JP | 2017095979 | A | 6/2017 |

* cited by examiner

METHOD OF MOUNTING LIGHTING APPLIANCE, MOUNTING STRUCTURE FOR LIGHTING APPLIANCE, LIGHTING APPLIANCE, AND METHOD OF CONSTRUCTING BUILDING

CROSS-REFERENCE TO RELATED APPLICATIONS

This is a national phase application based on International Patent Application No. PCT/JP2019/044872 filed Nov. 15, 2019, claiming priority to Japanese Patent Application No. 2018-225201 filed Nov. 30, 2018, Japanese Patent Application No. 2019-117528 filed Jun. 25, 2019, and Japanese Patent Application No. 2019-141711 filed Jul. 31, 2019, the entire contents of which all are incorporated herein by reference.

TECHNICAL FIELD

The present disclosure relates to a method of mounting a lighting appliance, a mounting structure for a lighting appliance, a lighting appliance, and a method of constructing a building.

BACKGROUND ART

Examples of a method of installing a square-type lighting appliance on a ceiling include a method in which an angular hole matching the shape and size of a lighting appliance body is formed in the ceiling and a lighting body is fixed to a hanging bolt, which is a ceiling component.

CITATION LIST

Patent Literature

Patent Literature 1: JP 2015-32467 A
Patent Literature 2: JP 2009-231016 A
Patent Literature 3: JP 2012-248308 A

SUMMARY OF INVENTION

Technical Problem

The present disclosure provides a method of mounting a lighting appliance that can be easily attached to a building material, a mounting structure for a lighting appliance, a lighting appliance, and a method of constructing a building.

Solution to Problem

According to one aspect of the present disclosure, a method of mounting a lighting appliance, including: fitting an annular mounting bracket into a mounting hole formed in a building material; passing an electrical cable of a power supply unit through an inner opening of the annular mounting bracket, and positioning a power supply side connector provided at an end portion of the electrical cable on a front side of the building material, the power supply unit being disposed at a position that does not overlap the mounting hole on a rear side of the building material; connecting the power supply side connector to a lighting appliance side connector fixed to an upper surface of a fitting adapter provided on a rear surface of a lighting appliance body on a side opposite to a light emitting surface of the lighting appliance body, the lighting appliance body including a plurality of light sources disposed in a region larger than an area of the mounting hole; and fitting the fitting adapter in which the power supply side connector is connected to the lighting appliance side connector into the inner opening of the mounting bracket fitted into the mounting hole, to thereby expose the upper surface of the fitting adapter to a space on a rear side of the building material.

Advantageous Effects of Invention

According to the present disclosure, it is possible to provide a method of mounting a lighting appliance that can be easily attached to a building material, a mounting structure for a lighting appliance, a lighting appliance, and a method of constructing a building.

DESCRIPTION OF EMBODIMENTS

Figure 1:
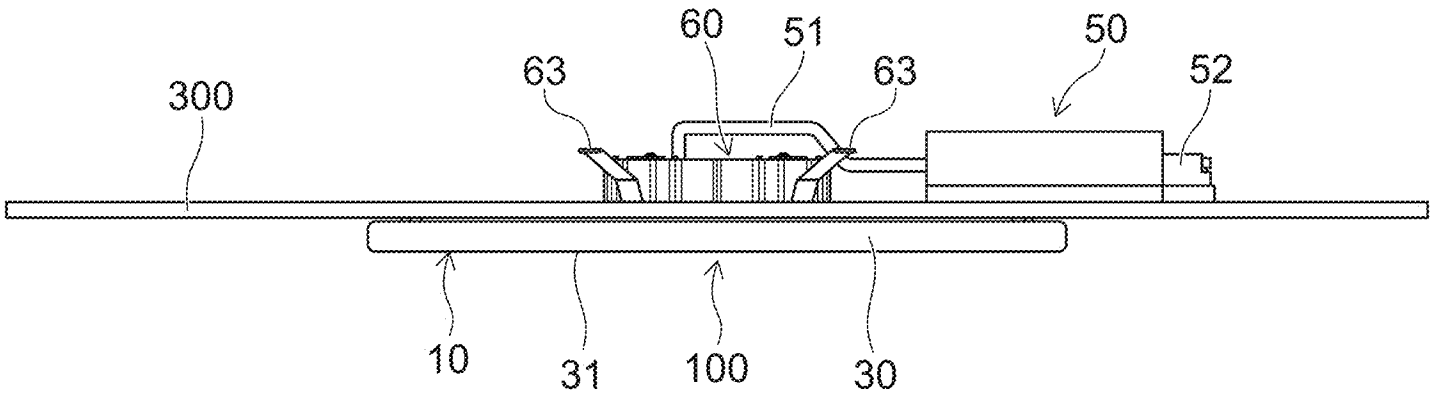
FIG. 1 is a side view illustrating a state in which a lighting appliance according to an embodiment is attached to a ceiling material.

Certain embodiments will be described below with reference to the drawings.

In the drawings, the same elements are given the same reference sings.

FIG. 1 is a side view illustrating a state in which a lighting appliance 100 according to an embodiment is attached to a ceiling material 300, for example, which is a building material.

Figure 2:
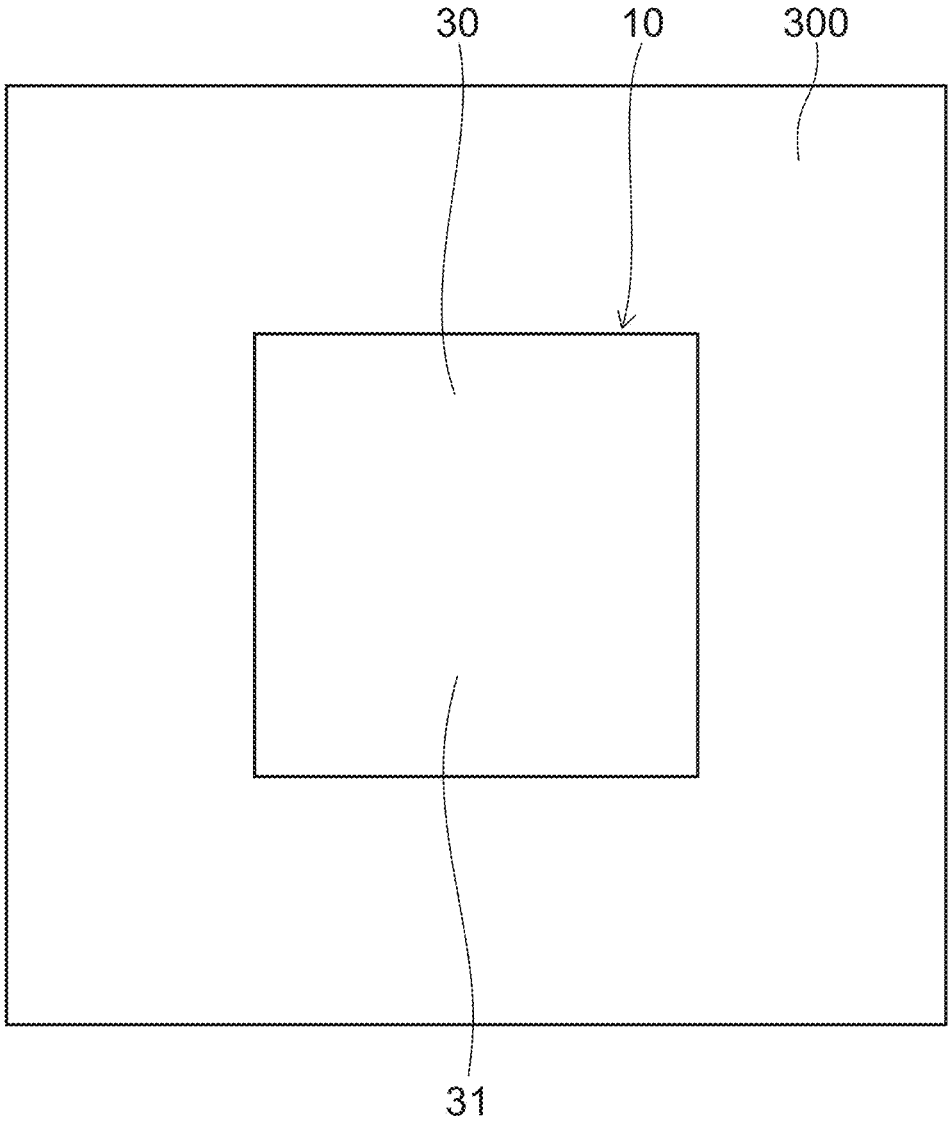
FIG. 2 is a plan view of a light emitting surface of the lighting appliance according to the embodiment.

FIG. 2 is a plan view of a main light emitting surface 31 of the lighting appliance 100.

Figure 3:
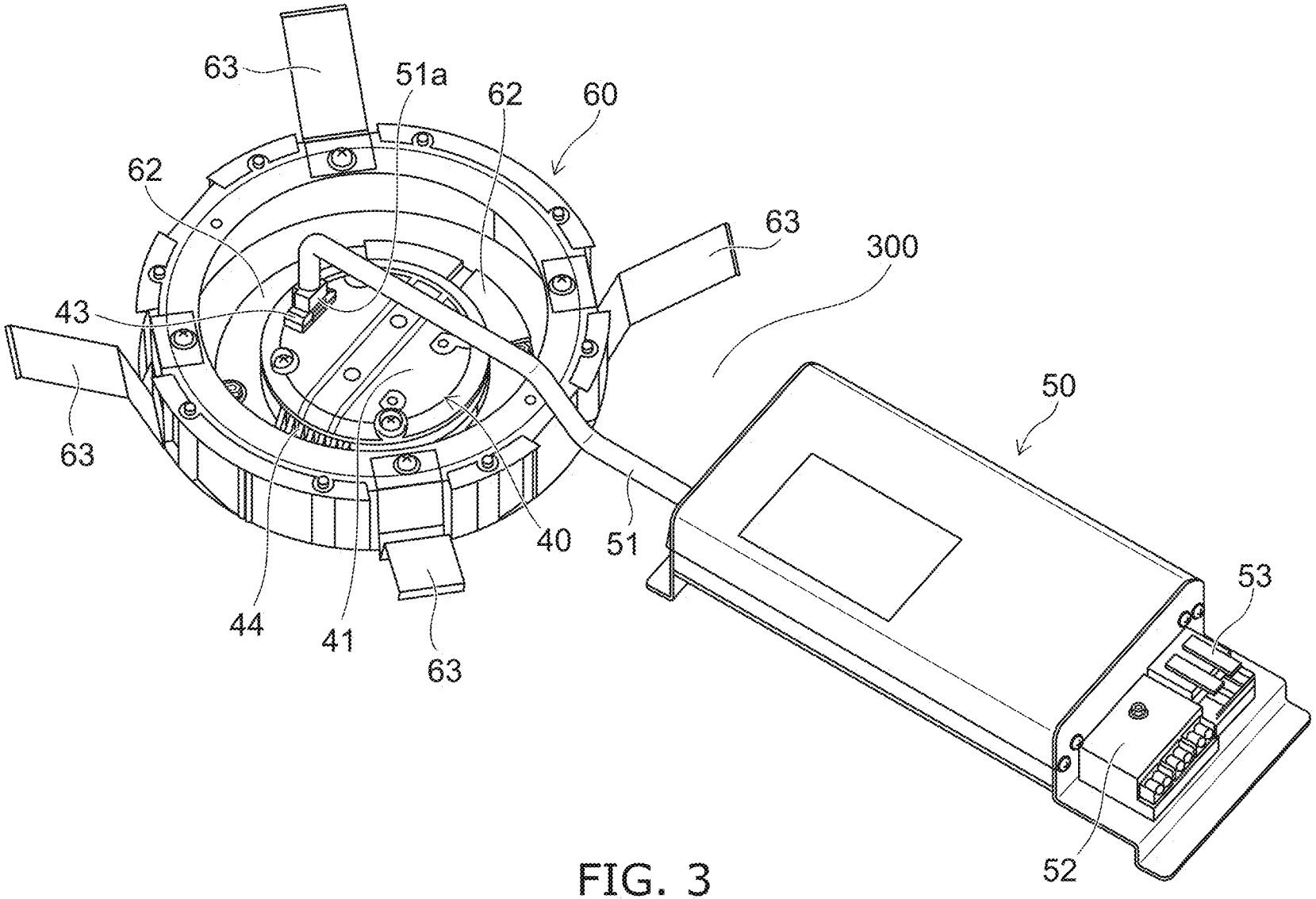
FIG. 3 is a perspective view of elements located on the rear side of the ceiling material among the elements illustrated in FIG. 1.

FIG. 3 is a perspective view of elements located on a rear side of the ceiling material 300 among the elements illustrated in FIG. 1.

Figure 4:
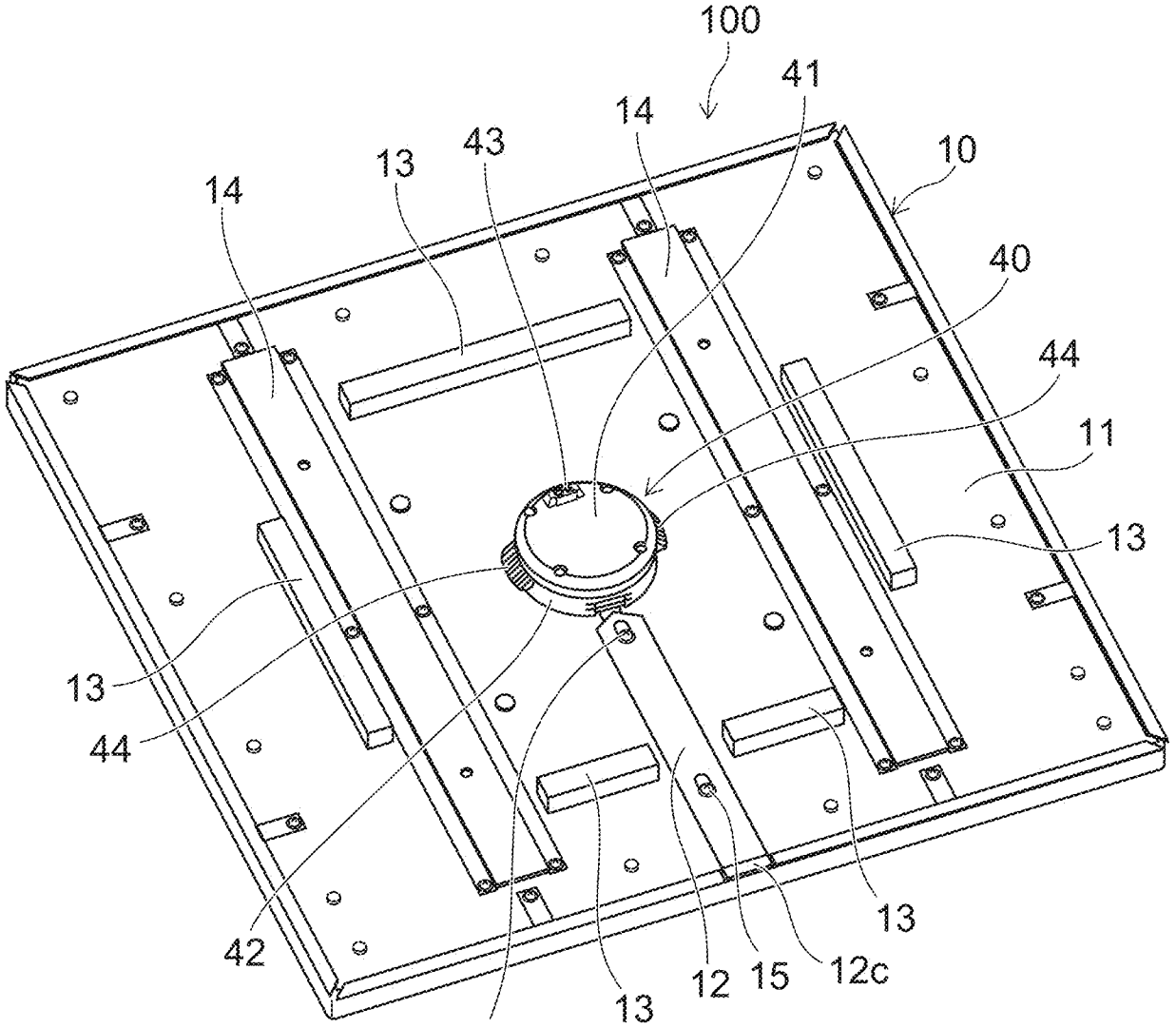
FIG. 4 is a perspective view of the rear side of the lighting appliance according to the embodiment.

FIG. 4 is a perspective view of a rear surface of the lighting appliance 100.

The lighting appliance 100 includes a lighting appliance body 10 and a fitting adapter 40.

As illustrated in FIG. 4, the fitting adapter 40 is disposed on a rear surface of a base plate 11.

The fitting adapter 40 is fixed to the rear surface of the base plate 11 by, for example, using screws.

The fitting adapter 40 is formed into, for example, a circular truncated cone shape.

A lighting appliance side connector 43 having a socket structure, for example, is fixed to an upper surface of the fitting adapter 40.

A metal stay 14 that reinforces the lighting appliance body 10 is disposed on the rear surface of the base plate 11.

For example, two metal stays 14 extend along a single side of the base plate 11 having a quadrilateral shape.

The two metal stays 14 are spaced apart from each other in a direction orthogonal to the extension direction of each metal stay 14 and are symmetrically disposed with respect to the fitting adapter 40 disposed at a central portion of the base plate 11.

A cushion material 13 is disposed on the rear surface of the base plate 11.

The lighting appliance body 10 further includes a light source module 20 and a light transmissive cover 30.

Figure 5:
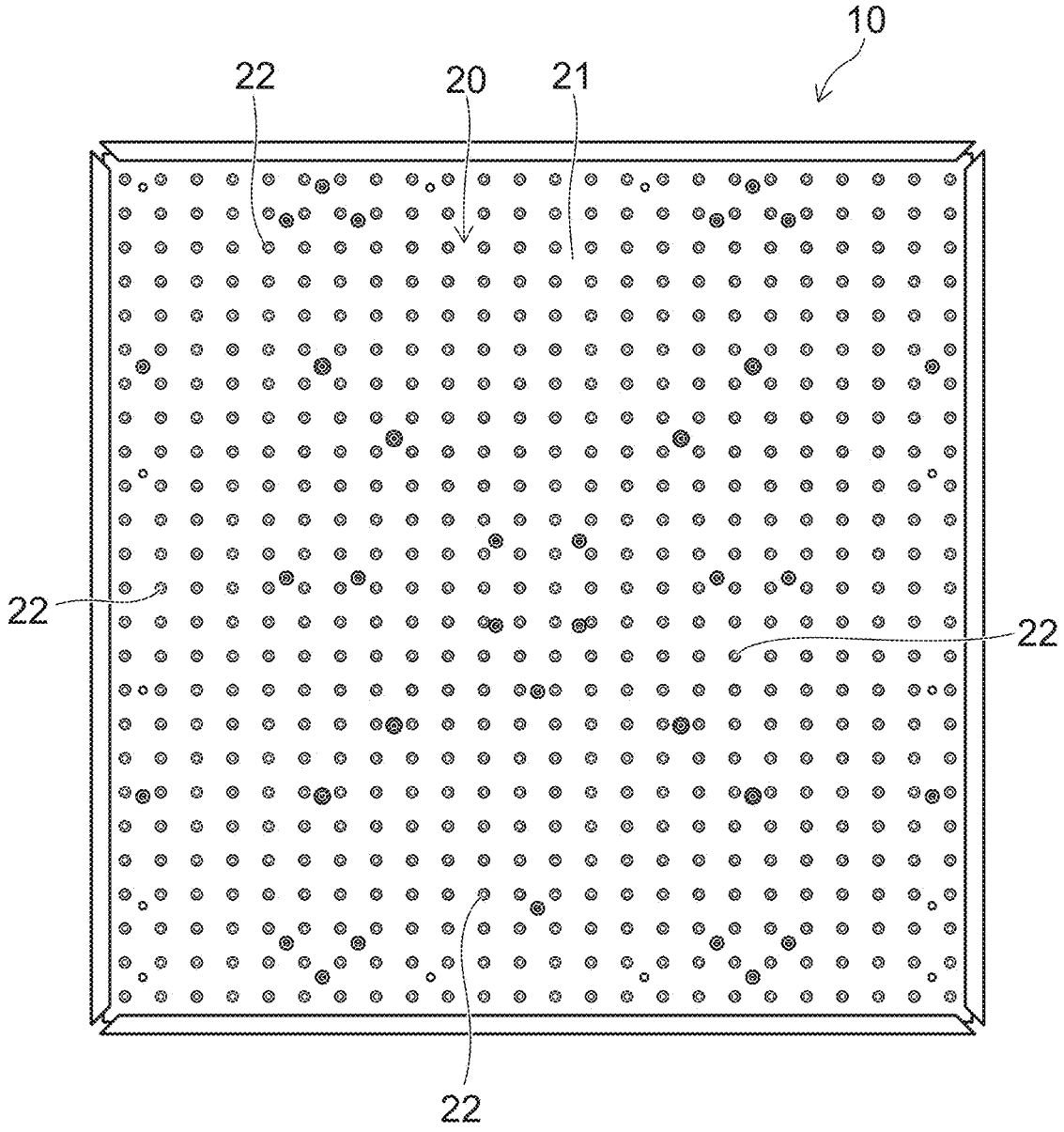
FIG. 5 is a plan view of a light source module according to the embodiment.

FIG. 5 is a plan view of a light emitting surface side of the light source module 20.

Figure 6:
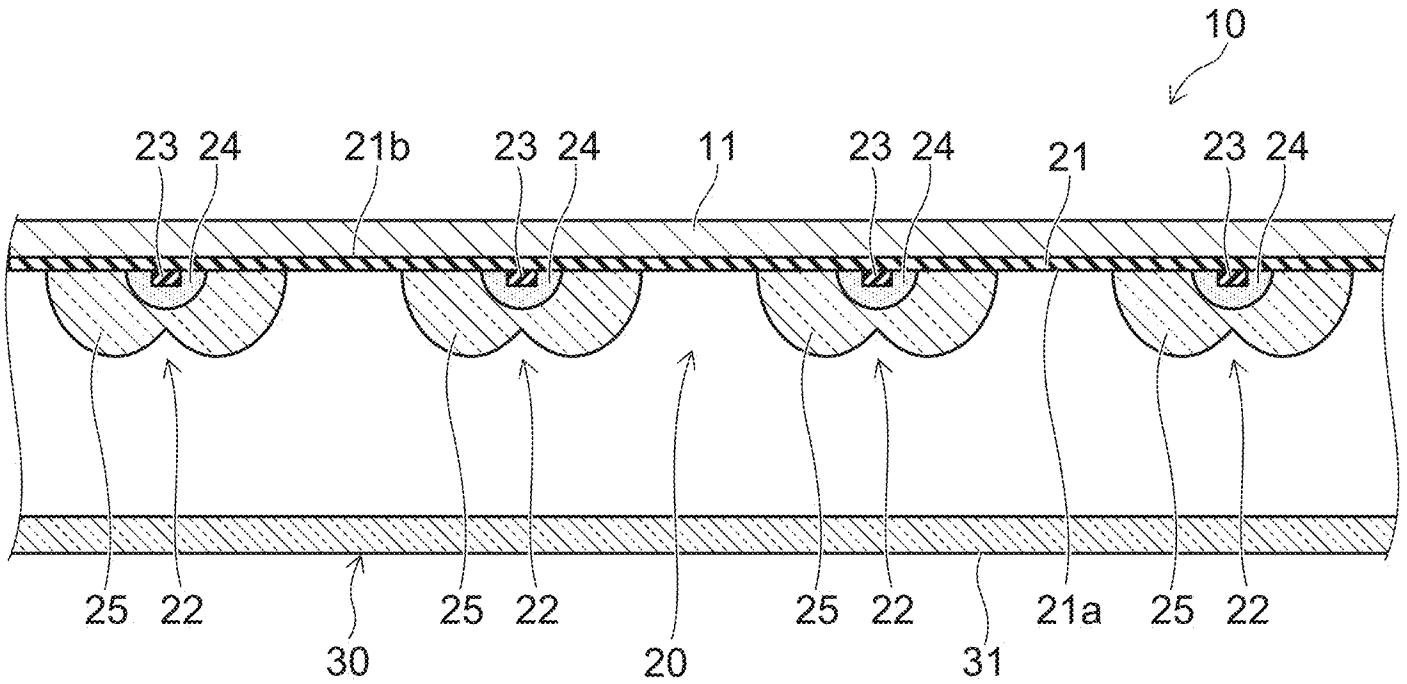
FIG. 6 is a schematic cross-sectional view of the light source module and a cover according to the embodiment.

FIG. 6 is a schematic cross-sectional view of the light source module 20 and the cover 30.

The light source module 20 is mounted on a surface opposite rear to the surface of the base plate 11, and the cover 30 is mounted to the base plate 11 so as to cover the light source module 20.

The base plate 11 is, for example, a metal plate and functions as a reinforcing plate and a heat sink plate of the light source module 20.

The light source module 20 includes a substrate 21 and a plurality of light sources 22.

The substrate 21 includes a light source arrangement surface 21*a* and a rear surface 21*b* on the opposite side of the light source arrangement surface 21*a*.

The plurality of light sources 22 are arranged periodically on the light source arrangement surface 21*a* of the substrate 21.

In the example illustrated in FIG. 5, the plurality of light sources 22 are arranged in a lattice pattern with an equal pitch.

The substrate 21 is an insulating substrate made of, for example, a resin or ceramic, and a conductor pattern is formed on the light source arrangement surface 21*a* of the substrate 21.

Each of the light sources 22 includes, for example, a light emitting element 23 such as a Light Emitting Diode (LED), a phosphor layer 24, and a resin member 25.

The light emitting element 23 is mounted on the light source arrangement surface 21*a* of the substrate 21, and electrodes of the light emitting element 23 are electrically connected to the conductor pattern formed on the substrate 21.

The conductor pattern formed on the substrate 21 is electrically connected to the lighting appliance side connector 43 provided on the upper surface of the fitting adapter 40.

The phosphor layer 24 covers the light emitting element 23, and the resin member 25 covers the phosphor layer 24.

The resin member 25 is recessed at a portion that covers the vicinity of the center of the upper surface of the light emitting element 23.

With such a shape, the resin member 25 functions as a lens that affords batwing light distribution characteristics to the light source 22.

Figure 7:
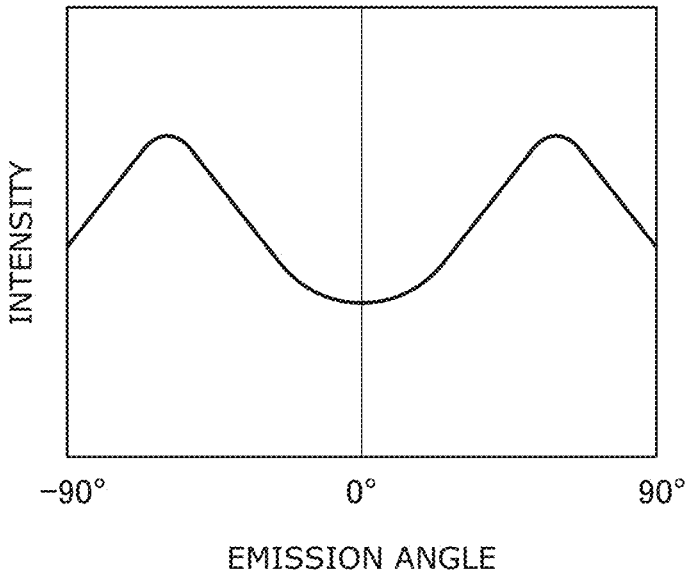
FIG. 7 is a light distribution characteristic diagram of a light source according to the embodiment.

FIG. 7 is a schematic diagram illustrating an example of batwing light distribution characteristics.

In FIG. 7, the horizontal axis represents an emission angle of light emitted from each light source 22, where the direction perpendicular to the light source arrangement surface on which the light sources 22 are disposed is 0°.

The vertical axis represents the intensity of light emitted from the light sources 22.

A batwing light distribution characteristic is a light distribution characteristic having a first intensity peak in a region in which the emission angle is in a range of 0° to −90°, the first intensity peak being greater than intensity at an emission angle of 0°, and having a second intensity peak in a region in which the emission angle is in a range of 0° to 90°, the second intensity peak being greater than intensity at an emission angle of 0°.

With the light sources 22 having the batwing light distribution characteristic, even when there is a short distance between the light sources 22 and the cover 30 due to reduction in thickness of the lighting appliance body 10, a uniform light emitting surface with reduced unevenness in luminance can be obtained.

Further, a person viewing the main light emitting surface 31 of the cover 30 can be less likely to feel that the light sources 22 are too bright at certain points.

The cover 30 can transmit the light emitted by the light sources 22.

The cover 30 is formed, for example, in a milky white color having light diffusivity achieved by dispersing titanium oxide or the like in a resin material.

The lighting appliance 100 according to the embodiment is attached to the ceiling material 300 by a mounting bracket 60.

Figure 8:
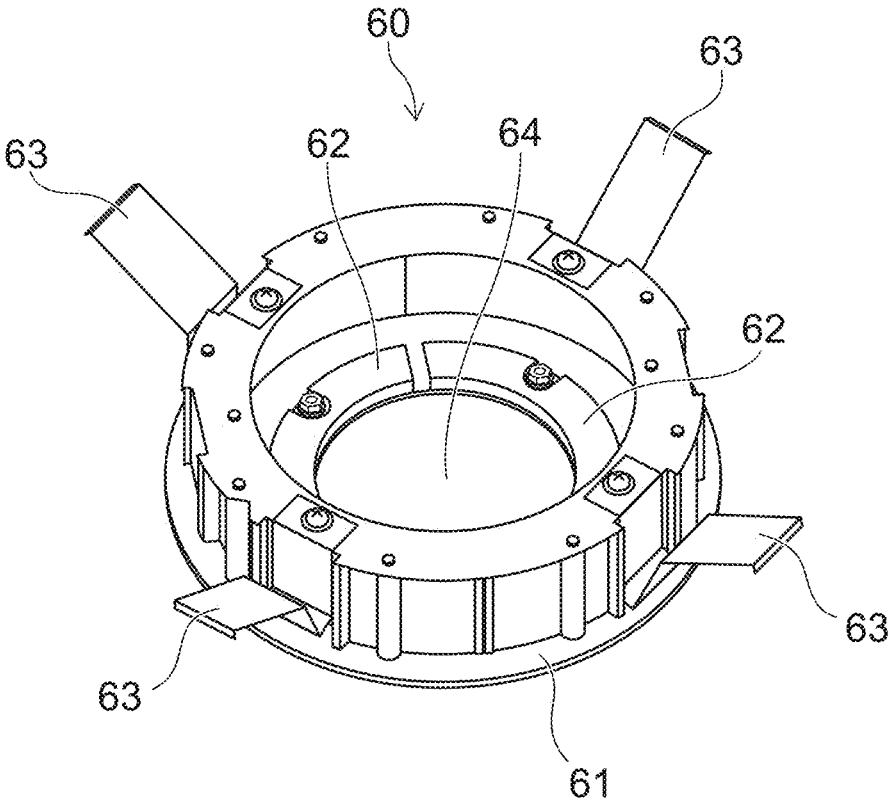
FIG. 8 is a perspective view of a mounting bracket according to the embodiment.

FIG. 8 is a perspective view of the mounting bracket 60.

The mounting bracket 60 is formed into an annular shape.

The inside of the mounting bracket 60 includes an opening 64.

A plurality of mounting springs 63 each having a leaf spring structure are provided on a side surface of the mounting bracket 60.

An annular flange 61 is provided on a lower surface of the mounting bracket 60.

The outer diameter of the flange 61 is greater than the diameter of a circular mounting hole formed in the ceiling material 300.

A bearing plate 62 is provided on the upper surface of the flange 61 along the edge of the opening 64.

The mounting bracket 60 is fitted into a mounting hole 300*a* formed in the ceiling material 300.

Figure 9:
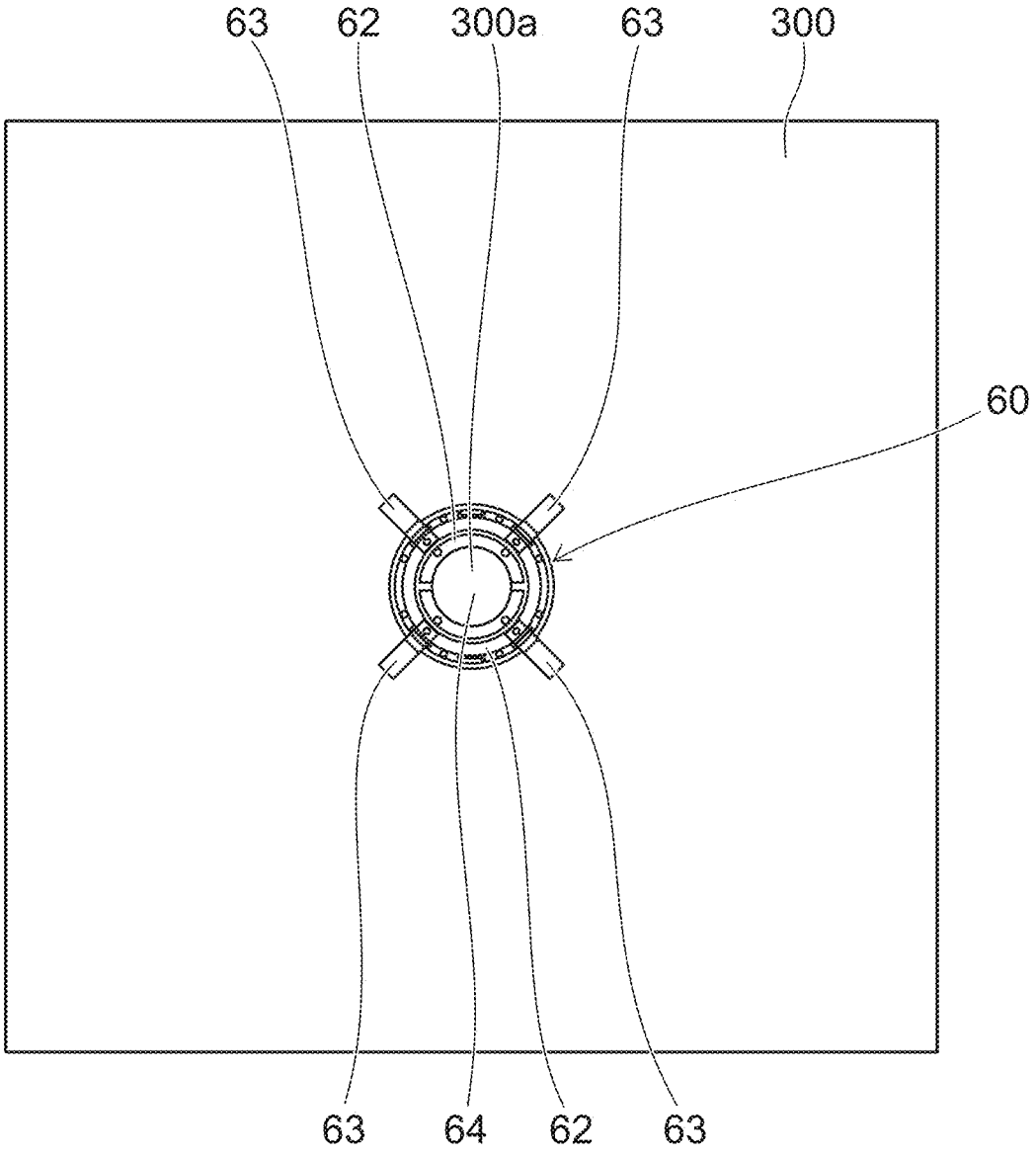
FIG. 9 is a top view of the mounting bracket according to the embodiment fitted into a mounting hole of the ceiling material.

FIG. 9 is a top view of the mounting bracket 60 fitted into the mounting hole 300*a* of the ceiling material 300.

FIG. 9 illustrates the rear side of the ceiling material 300.

Figure 10:
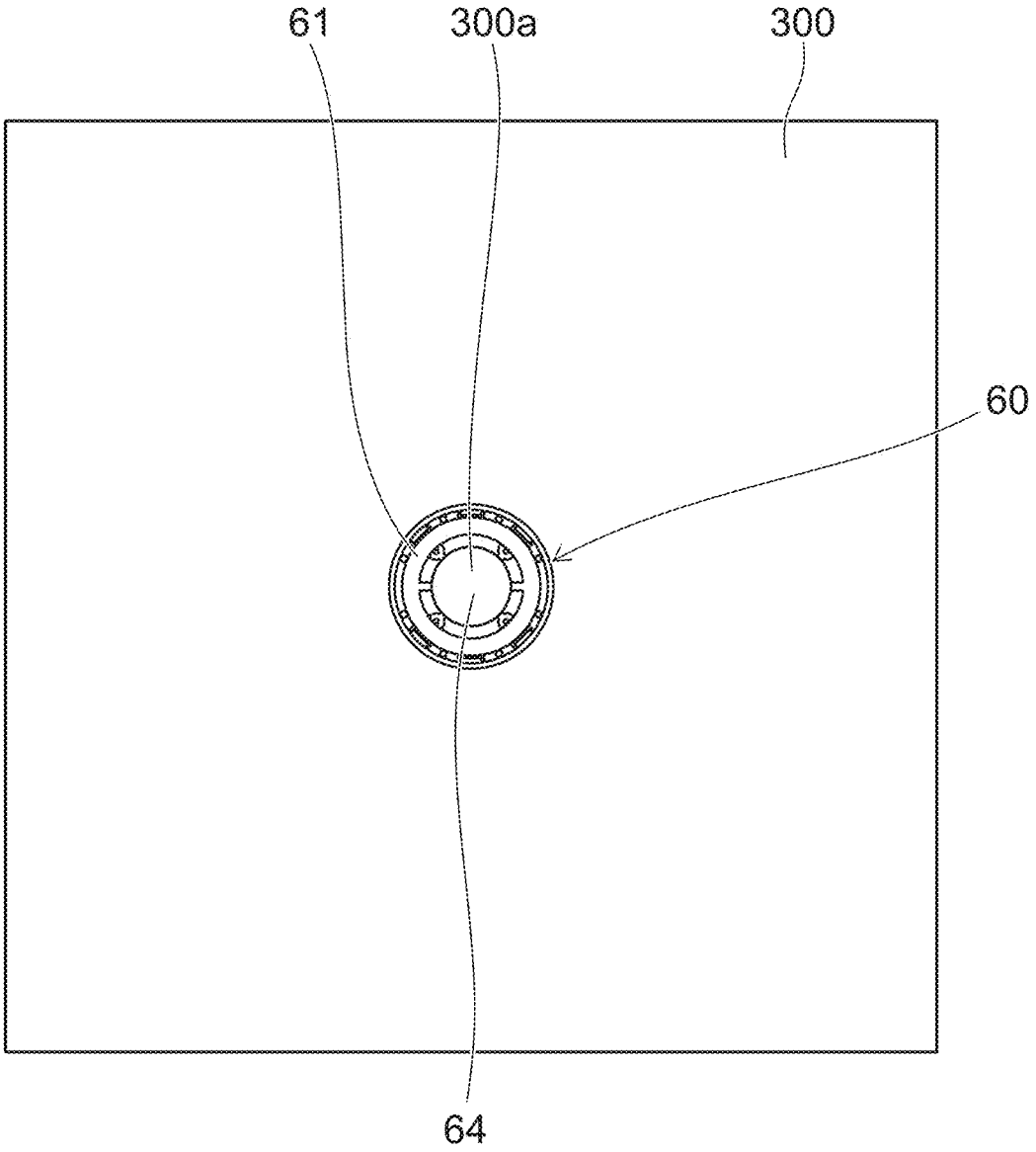
FIG. 10 is a bottom view of the mounting bracket according to the embodiment fitted into the mounting hole of the ceiling material.

FIG. 10 is a bottom view of the mounting bracket 60 fitted into the mounting hole 300*a* of the ceiling material 300.

FIG. 10 illustrates the front side of the ceiling material 300 facing an illumination target space.

The mounting springs 63 are disposed between a side surface of the mounting bracket 60 and an inner wall of the mounting hole 300*a* in a state in which the mounting springs 63 are deformed from their natural state.

Figure 12:
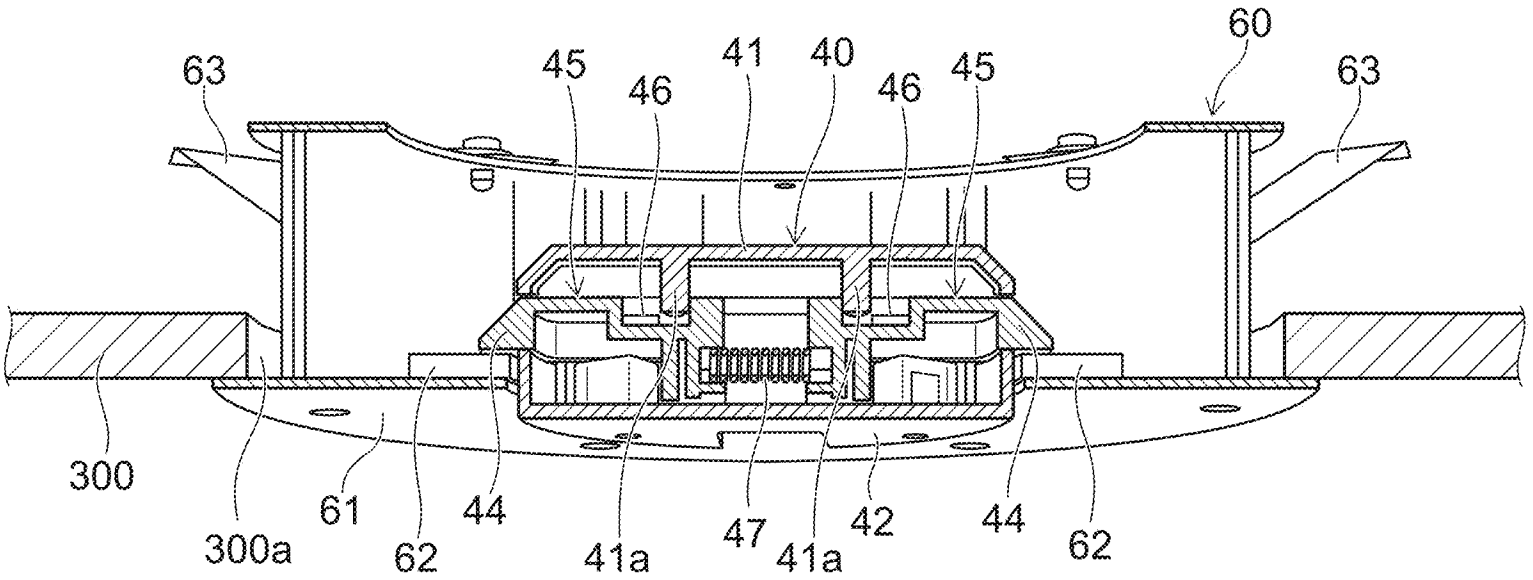
FIG. 12 is a cross-sectional perspective view illustrating the fitting structure of the mounting bracket and the fitting adapter according to the embodiment.

Restoring force of the mounting springs 63 acts on the mounting bracket 60 to bias the mounting bracket 60 upward and press the upper surface of the flange 61 against the front side surface of the ceiling material 300 (see FIG. 12).

As a result, the mounting bracket 60 is held in a state of being fitted into the mounting hole 300*a*.

If necessary, a power supply unit 50 illustrated in FIG. 3 is disposed on the rear side of the ceiling material 300 before fitting the mounting bracket 60 into the mounting hole 300*a* of the ceiling material 300.

The power supply unit 50 is passed from the mounting hole 300*a* to the rear side of the ceiling material 300 and is disposed at a position that does not overlap the mounting hole 300*a* on the rear side of the ceiling material 300.

In a case in which a power supply unit 50 is already installed on the rear side of the ceiling material 300 and is used as is, a power supply unit 50 need not be installed on the rear side of the ceiling material 300.

As illustrated in FIG. 3, the power supply unit 50 includes terminal stands 52 and 53 that are connectable to an external power supply (commercial power supply).

An electrical cable 51 is extended from the power supply unit 50.

The terminals of each of the terminal stands 52 and 53 are electrically connected to a circuit board of the power supply unit 50, and the electrical cable 51 is electrically connected to the circuit board.

A power supply side connector 51*a* is provided at an end portion of the electrical cable 51.

In a state before the lighting appliance body 10 is attached to the ceiling material 300, the electrical cable 51 is passed through the mounting hole 300*a* of the ceiling material 300 and the opening 64 inside of the mounting bracket 60 fitted into the mounting hole 300*a*, and the power supply side connector 51*a* is positioned on the front side of the ceiling material 300.

A worker that performs the mounting work of the lighting appliance 100 brings the lighting appliance 100 closer to the ceiling material 300 and holds the lighting appliance 100 with one hand while holding the power supply side connector 51*a* of the electrical cable 51 that hangs from the mounting hole 300*a* with the other hand.

Then, the worker connects the power supply side connector 51*a* to the lighting appliance side connector 43 fixed to the upper surface of the fitting adapter 40 provided on the rear surface of the lighting appliance body 10.

After the power supply side connector Ma is connected to the lighting appliance side connector 43, the fitting adapter 40 is fitted into the opening 64 on the inside of the mounting bracket 60, which is fitted into the mounting hole 300*a* of the ceiling material 300.

Figure 11:
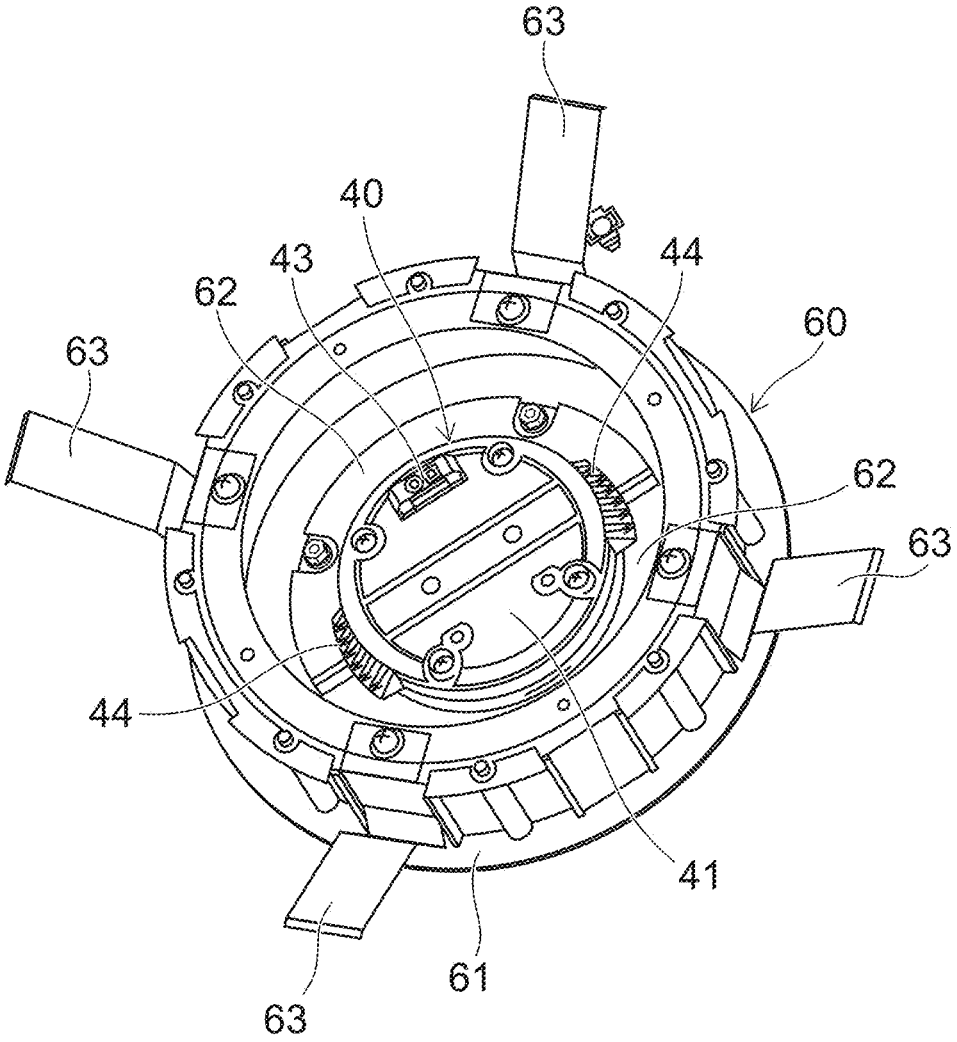
FIG. 11 is a perspective view illustrating a fitting structure of the mounting bracket and a fitting adapter according to the embodiment.

FIG. 11 is a perspective view illustrating the fitting structure of the mounting bracket 60 and the fitting adapter 40.

FIG. 12 is a cross-sectional perspective view illustrating the fitting structure of the mounting bracket 60 and the fitting adapter 40.

The fitting adapter 40 includes a top case 41, a bottom case 42, two slide members 45, and a spring 47 connecting the two slide members 45.

A claw portion 44 with an inclined surface is provided on the tip end of each of the slide members 45.

Sliding movement of the two slide members 45 generated by extension and contraction of the spring 47 causes the claw portions 44 to hook onto the insides of the cases 41 and 42 through an opening formed between the top case 41 and the bottom case 42, and to protrude outward of the cases 41 and 42.

FIG. 11 and FIG. 12 illustrate a state in which the claw portions 44 protrude to the outside of the cases 41 and 42 and ride on the upper surface of the bearing plate 62 of the mounting bracket 60.

As illustrated in FIG. 12, stoppers 41*a* protruding downward from the top case 41 are positioned in a recessed portion 46 formed in the upper surface of the slide members 45, and contact between the stoppers 41*a* and the wall surface of the recessed portion 46 restricts movement of the two slide members 45 in the direction of separating from each other.

Typically, the claw portions 44 protrude outward from the cases 41 and 42.

When the fitting adapter 40 is fitted inside the mounting bracket 60, the inner peripheral wall of the flange 61 and the inner peripheral wall of the bearing plate 62 of the mounting bracket 60 abut against the inclined surface of the claw portion 44.

Due to the force acting on the claw portion 44 from the inner peripheral wall of the flange 61 and the inner peripheral wall of the bearing plate 62, the two slide members 45 slide toward each other while compressing the spring 47.

Each claw portion 44 is recessed inside the cases 41 and 42 and allows the fitting adapter 40 to fit inside the mounting bracket 60.

Then, when the claw portion 44 is moved to a position above the bearing plate 62, the force acting on the claw portion 44 from the inner peripheral wall of the bearing plate 62 is released, and the two slide members 45 are biased in a direction separating from each other by the restoring force of the spring 47.

Each claw portion 44 protrudes outward of the cases 41 and 42, and the lower surface of each claw portion 44 rides on the upper surface of the bearing plate 62.

As a result, the fitting adapter 40 and the lighting appliance body 10 fixed with the fitting adapter 40 are prevented from falling out of the mounting bracket 60.

In a state in which the fitting adapter 40 is fitted into the mounting bracket 60, the cushion material 13 provided on the rear surface of the base plate 11 illustrated in FIG. 4 adheres to the front side surface of the ceiling material 300.

As illustrated in FIG. 1, the main light emitting surface 31 of the cover 30 is parallel to the surface of the front side of the ceiling material 300, and is directed toward a space below the ceiling material 300.

Alternatively, the lighting appliance 100 according to the embodiment can be attached to a wall material by using the same method as the method of mounting the ceiling material 300.

When the lighting appliance 100 is attached to a wall material, the main light emitting surface 31 of the cover 30 is parallel to the wall surface and is directed toward a side space of the wall material.

The plurality of light sources 22 in the light source module 20 are disposed over a region larger than the area of the mounting hole 300*a* of the ceiling material 300 and the area of the opening 64 of the mounting bracket 60.

The light sources 22 are also disposed in a region overlapping the fitting adapter 40 in the lighting appliance body 10.

Thus, in the main light emitting surface 31, the center portion, which is the region overlapping the mounting hole 300*a* and the fitting adapter 40, can also be illuminated, and a light emitting surface is obtained over a wide area.

In a state in which the fitting adapter 40 is fitted into the mounting bracket 60, as illustrated in FIG. 3, the upper surface of the fitting adapter 40 and the connection portion between the power supply side connector 51*a* and the lighting appliance side connector 43 are exposed in a space on the rear side of the ceiling material 300.

The fitting adapter 40 exposes the upper surface of the fitting adapter 40 to a space on the rear side of the ceiling material 300 and is fixed to the mounting bracket 60.

The power supply unit 50 is arranged at a position that does not overlap the fitting adapter 40 and does not cover the fitting adapter 40.

Therefore, heat generated by the light source module 20 can be dissipated through the fitting adapter 40 to the space on the rear side of the ceiling material 300.

Next, a method of removing the lighting appliance 100 from the ceiling material 300 will be described.

As illustrated in FIG. 4, a detachment member 12 is provided on the rear surface of the base plate 11.

In a state in which a first end portion 12*c* of the detachment member 12 is exposed to the side surface of the lighting appliance body 10, and the lighting appliance body 10 is attached to the ceiling material 300, the worker can grip the first end portion 12*c* of the detachment member 12 with a finger or a jig.

The other end portion of the detachment member 12 is coupled to the slide members 45 of the fitting adapter 40.

Figure 13:
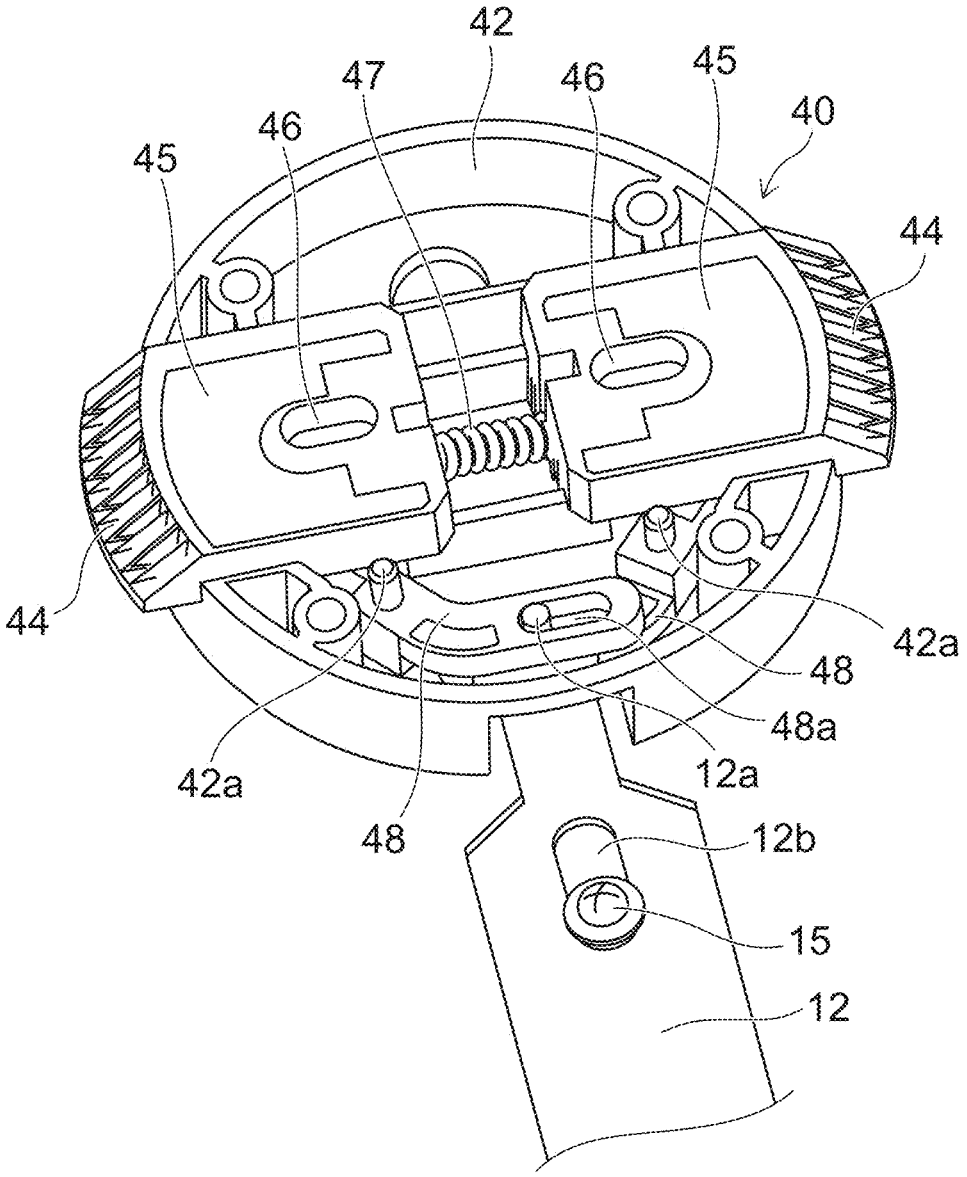
FIG. 13 is a perspective view illustrating a coupling structure of the fitting adapter and a detachment member according to the embodiment.
Figure 14:
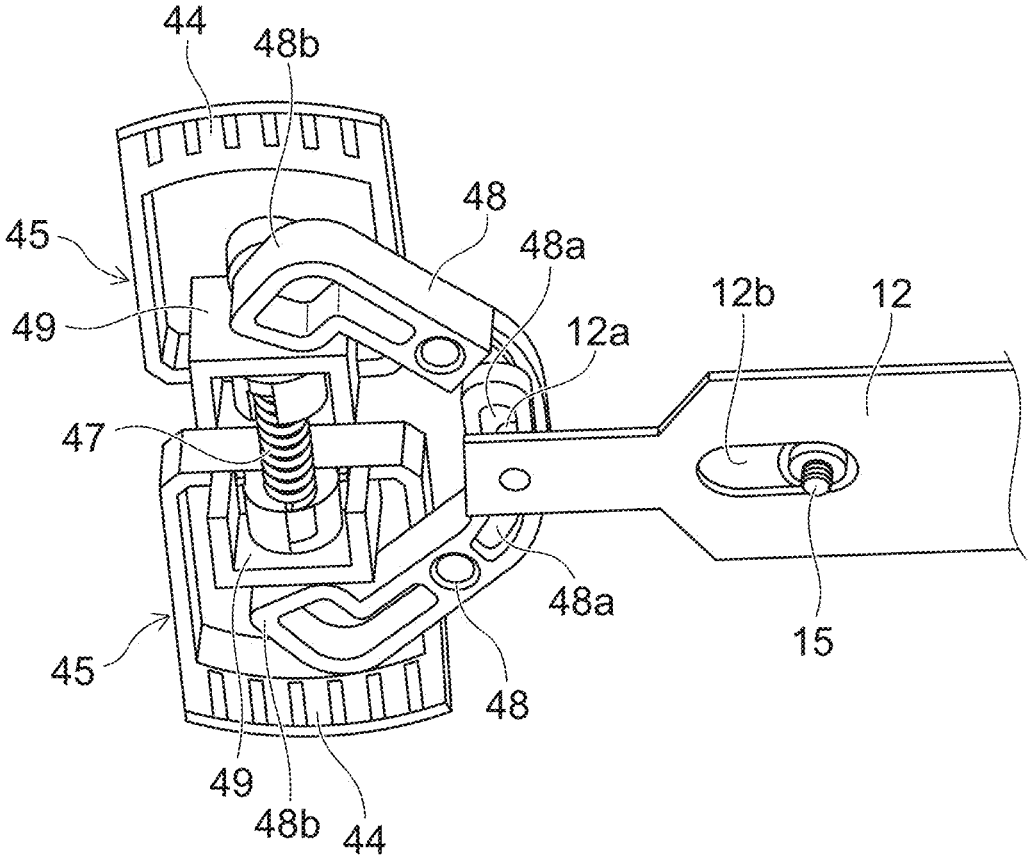
FIG. 14 is a perspective view illustrating a coupling structure of the fitting adapter and the detachment member according to the embodiment.

FIGS. 13 and 14 are perspective views illustrating the coupling structure of the fitting adapter 40 and the detachment member 12.

FIG. 13 illustrates a state in which the top case 41 of the fitting adapter 40 is removed.

FIG. 14 is a perspective view of the coupling structure of the detachment member 12 and the slide members 45 viewed from the rear side in which the bottom case 42 is also removed from the state in FIG. 13.

The detachment member 12 and the slide members 45 are connected via two arm members 48.

Each arm member 48 can rotate around a shaft portion 42*a* provided in the bottom case 42 as a fulcrum.

A through hole 48*a* is formed in one end portion of each of the arm members 48, and a pin 12*a* provided at the other end of the detachment member 12 is engaged in the through holes 48*a*.

A long hole 12*b* is formed in the detachment member 12, and a screw 15 is positioned in the long hole 12*b*.

The screw 15 is attached to the base plate 11.

The detachment member 12 can be slid along the longitudinal direction of the detachment member 12 by the worker pulling the first end portion 12*c* of the detachment member 12 with a jig, for example.

At this time, sliding movement of the detachment member 12 is guided by contact between the inner wall of the long hole 12*b* and the screw 15.

When the detachment member 12 is pulled in a direction in which the first end portion 12*c* of the detachment member 12 protrudes from the lighting appliance body 10, the pair of arm members 48 engaged with the pin 12*a* of the detachment member 12 rotate around the shaft portion 42*a* as the fulcrum.

The rotation of the arm members 48 causes second end portions 48*b* of the arm members 48 illustrated in FIG. 14 to push a protruding portion 49 provided on the lower surface of the slide members 45.

As a result, the two slide members 45 slide in directions approaching each other by compressing the spring 47.

Due to the sliding movement of the slide members 45, the state in which the claw portions 44 ride on the bearing plate 62 of the mounting bracket 60 illustrated in FIG. 12 is released, the fitting adapter 40 is detached from the mounting bracket 60, and the lighting appliance body 10 can be removed from the ceiling material 300.

Figure 15:
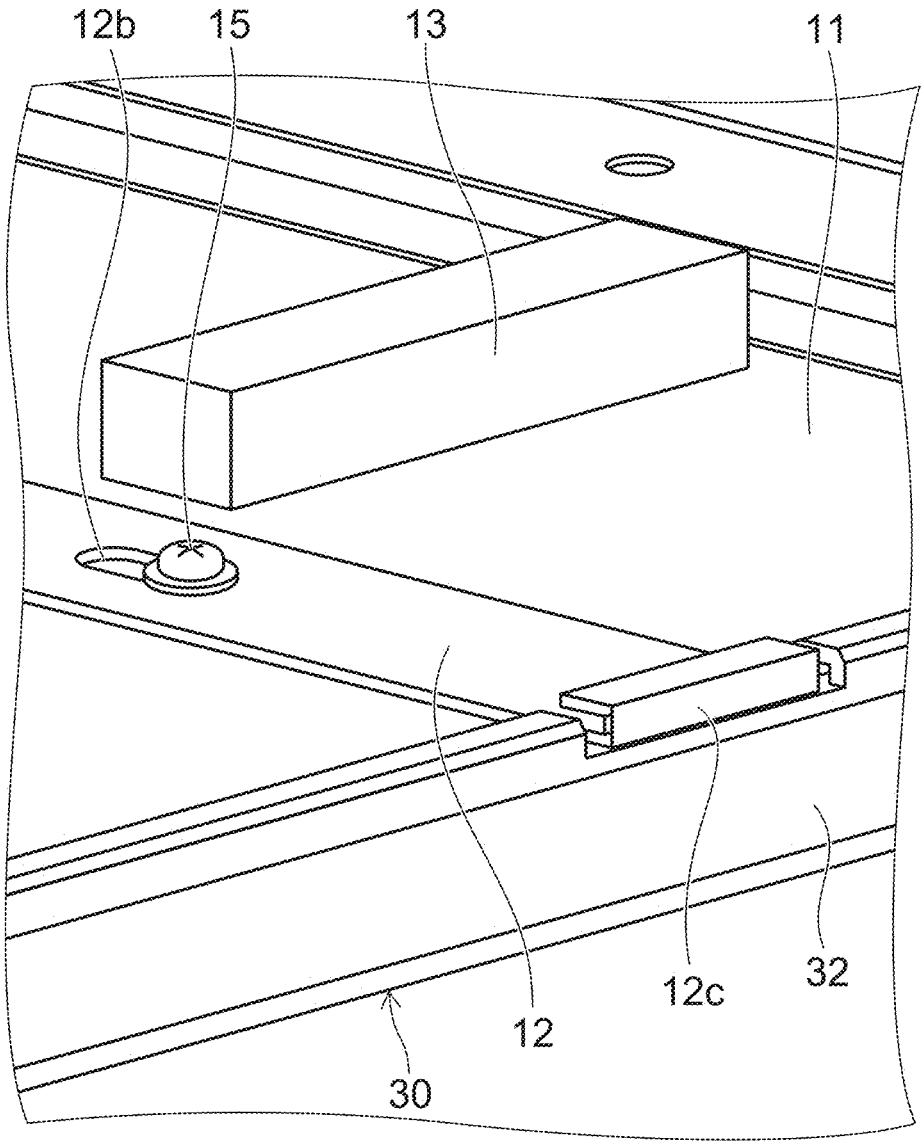
FIG. 15 is a perspective view of one end portion of the detachment member according to the embodiment.

FIG. 15 is a perspective view of the first end portion 12*c* of the detachment member 12.

The first end portion 12*c* of the detachment member 12 is bent toward the inside of the lighting appliance body 10 such that a jig can be hooked on the first end portion 12*c*.

The position of the first end portion 12*c* of the detachment member 12 is aligned with a notch formed in the side surface 32 of the cover 30, and is exposed to the side surface of the lighting appliance body 10.

The detachment member 12 is a metal member that is painted in the same color or a similar color as the color of the cover 30 (e.g., a milky white color).

The detachment member 12 is painted in white, for example.

Therefore, particularly when not illuminated, the first end portion 12*c* of the detachment member 12 is not noticeable on the side surface of the lighting appliance body 10, and appearance quality is not impaired.

According to the embodiment described above, an angular hole matching the shape and size of the lighting appliance body 10 can not be punched into the building material, and mounting to the ceiling material 300 can be performed by only punching one mounting hole 300*a* matching the size of the fitting adapter 40 smaller than the size of the lighting appliance body 10.

Then, the fitting adapter 40 is fitted into the mounting bracket 60 fitted into the mounting hole 300*a*, and the lighting appliance body 10 can be easily attached to the ceiling material 300.

The lighting appliance side connector 43 is fixed to the upper surface of the fitting adapter 40 rather than hanging while connected to one end of the cable.

On the other hand, the power supply side connector 51*a* is lead out from the power supply unit 50 by the electrical cable 51.

Accordingly, the power supply side connector Ma is positioned at the worker's hand at the front side of the ceiling material 300 through the mounting hole 300*a* of the ceiling material 300 and the opening 64 of the mounting bracket 60, and the worker can grip the power supply side connector M a with one hand and put their other hand on the light emitting surface 31 of the lighting appliance 100 to support the lighting appliance 100 and connect the power supply side connector Ma to the lighting appliance side connector 43.

The lighting appliance side connector 43 itself can be not gripped by a hand.

As a result, even if the planar size of the lighting appliance body 10 increases, one worker can easily perform electrical connection between the power supply unit 50 and the lighting appliance 100 and mount the lighting appliance 100 to the ceiling material 300.

When removing the lighting appliance 100 from the ceiling material 300, by putting one hand on the light emitting surface 31 of the lighting appliance 100 to support the lighting appliance 100 and gripping and pulling the first end of the detachment member 12 described above with the other hand, engagement between the claw portions 44 of the fitting adapter 40 and the mounting bracket 60 can be released, and the lighting appliance 100 can be removed from the ceiling material 300.

After this, while still supporting the lighting appliance 100 with one hand, the power supply side connector 51*a* can be removed from the lighting appliance side connector 43 by moving the other hand from the detachment member 12 to the power supply side connector Ma and pulling the power supply side connector Ma.

In other words, one worker can easily remove the lighting appliance 100 from the ceiling material 300 and release the electrical connection between the power supply unit 50 and the lighting appliance 100.

According to such an embodiment, a variety of kinds of lighting appliance main bodies 10 can be easily connected to a common power supply unit 50 with one operation, and thus other kinds of lighting appliance main bodies 10 can be changed with minimal time and effort.

When changing the lighting appliance body 10, the common power supply unit 50 does not need to be detached from the ceiling material 300.

The mounting bracket 60 is formed into an annular shape, and the upper portion thereof is opened without being occluded.

Accordingly, after the power supply side connector Ma is connected to the lighting appliance side connector 43, when the fitting adapter 40 is fitted into the mounting bracket 60, the electrical cable 51 can be retracted into the space above the mounting bracket 60 without being clamped or hooked somewhere else, and the fitting adapter 40 can be fit into the mounting bracket 60 without hindrance.

Next, a packaging structure of the lighting appliance 100 according to the embodiment described above will be described.

Figure 16:
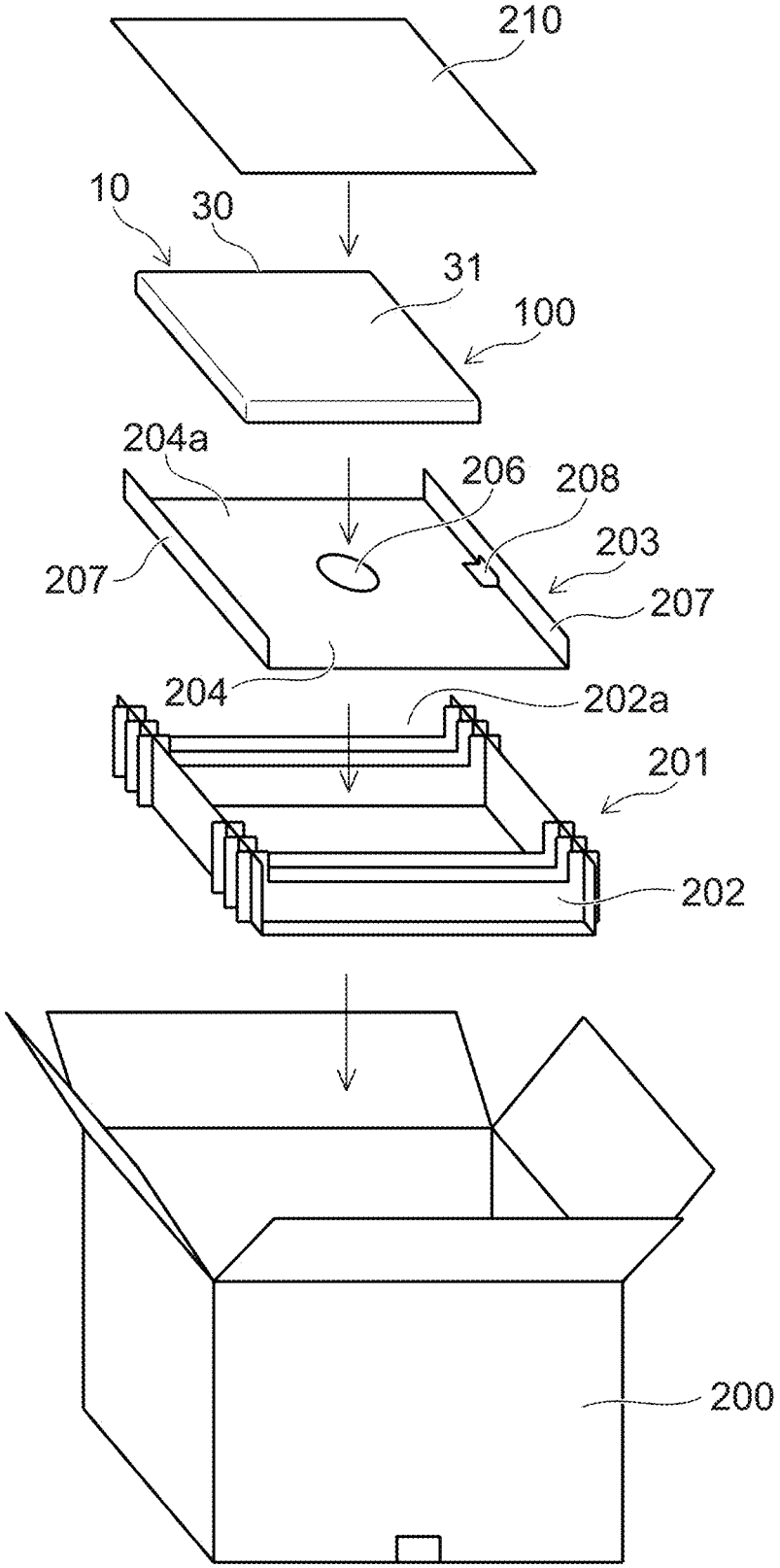
FIG. 16 is an exploded perspective view of packing materials for the lighting appliance according to the embodiment.

FIG. 16 is an exploded perspective view of packaging materials of the lighting appliance 100.

The lighting appliance 100 is housed in an outer box 200 and transported to an installation site or similar facility in a state of being held by a first holding member 201 and a second holding member 203.

The second holding member 203 includes a main plate portion 204 and a pair of side plate portions 207.

The planar shape of the main plate portion 204 is, for example, a quadrangular shape with four sides.

The side plate portions 207 are provided on each of two mutually opposing sides of the four sides of the main plate portion 204.

The remaining two sides of the main plate portion 204 are not provided with a side plate portion and are open.

The side plate portions 207 protrude above an upper surface 204*a* of the main plate portion 204.

A notch 208 is formed in a corner portion (boundary portion) between one of the pair of side plate portions 207 and the main plate portion 204.

A circular hole 206 is formed at the center of the main plate portion 206.

The lighting appliance 100 is held by the second holding member 203 in a state in which the fitting adapter 40 is fitted into the hole 206 of the second holding member 203.

Figure 17:
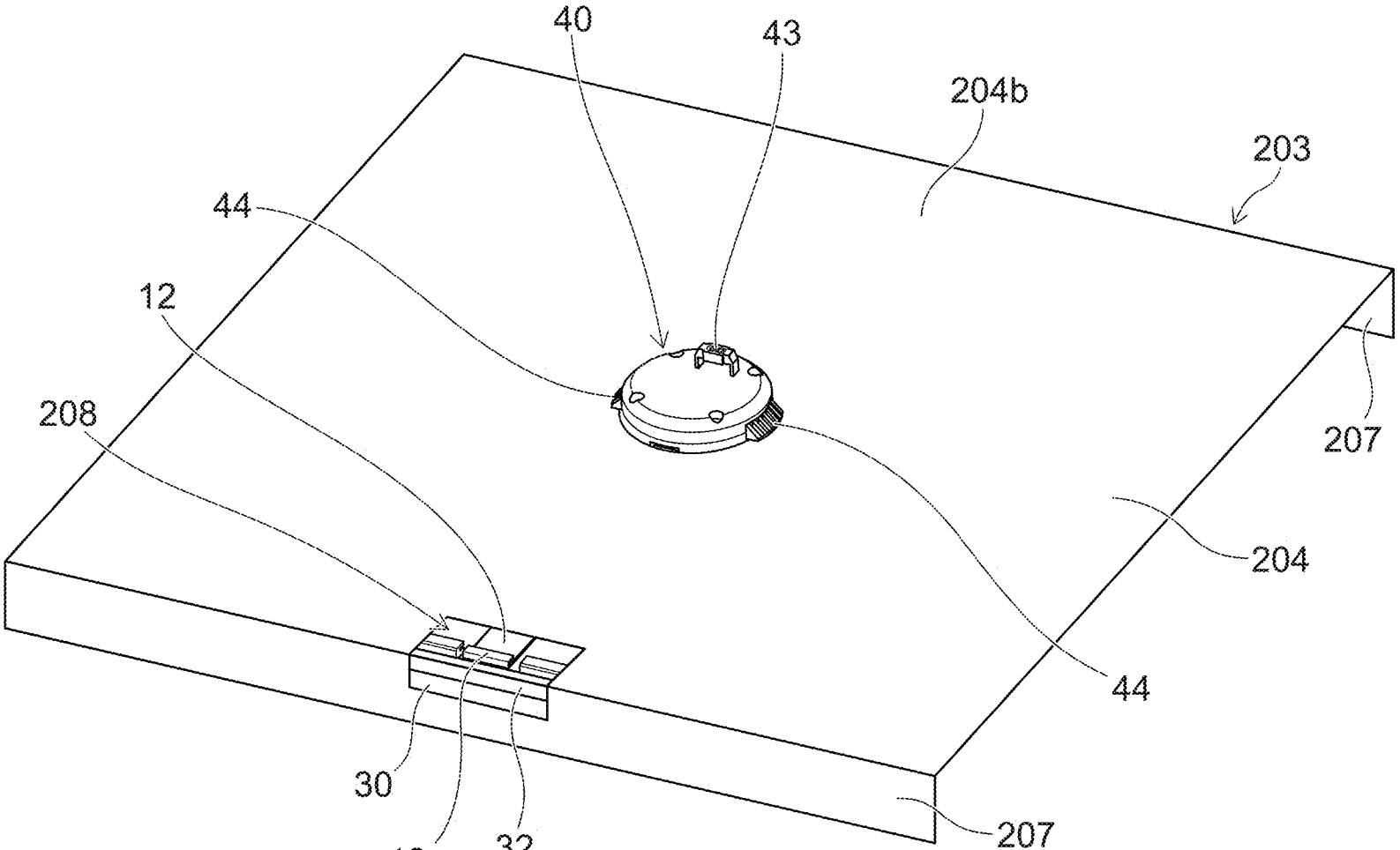
FIG. 17 is a perspective view illustrating a state in which the fitting adapter is fitted into a second holding member illustrated in FIG. 16.

FIG. 17 is a perspective view of the second holding member 203 fitted with the fitting adapter 40, and is a perspective view of a lower surface 204*b* side of the main plate portion 204.

The upper surface of the fitting adapter 40 is exposed to the lower surface 204*b* side of the main plate portion 204 through the hole 206, and the claw portions 44 of the fitting adapter 40 ride on and abut against the lower surface 204*b* of the main plate portion 204.

The first end portion 12*c* of the detachment member 12 is exposed in the notch 208.

The first holding member 201 includes a frame member 202 with a parallel cross structure.

A recessed portion 202*a* is formed in a portion of the frame member 202.

The main plate portion 204 of the second holding member 203 is mounted on a bottom portion of the recessed portion 202*a*.

In this state, the fitting adapter 40 fitted into the hole 206 of the second holding member 203 is positioned above the lower end of the frame member 202 of the first holding member 201 and within the opening inside the frame member 202.

The lighting appliance 100 is housed in the outer box 200 in a state of being held by the second holding member 203 and the first holding member 201.

The light emitting surface 31 of the lighting appliance 100 is oriented upward within the outer box 200 so as to not place load on the light emitting surface during transport.

A pad 210 is placed on the light emitting surface 31.

The planar size of the pad 210 is matched to the size of the inner dimensions of the outer box 200 such that the pad 210 covers the entire surface of the lighting appliance 100 held by the second holding member 203 and the first holding member 201.

The lighting appliance 100 held by the second holding member 203 and the first holding member 201 can be housed by being laminated in a plurality of layers within the outer box 200.

In other words, the first holding member 201, the second holding member 203, the lighting appliance 100, the pad 210, another first holding member 201, another second holding member 203, another lighting appliance 100, and another pad 210 can be laminated in order from below.

The fitting adapter 40 is positioned within the opening inside the frame member 202 of the first holding member 201 and does not interfere with other lighting appliances 100.

The fitting adapter 40 of the bottommost lighting appliance 100 does not come into contact with the bottom of the outer box 200.

In a state in which the second holding member 203 is mounted on the first holding member 201, the side plate portions 207 of the second holding member 203 remain in a state of being upright.

The height of the side plate portions 207 is the same as the depth (height of the side wall) of the recessed portion 202*a* of the first holding member 201.

The upper end position of the side plate portions 207 and the upper end position of the frame member 202 are aligned.

Thus, the holding structure of another lighting appliance 100 layered above restricts upward movement of the holding structure of the lower lighting appliance 100.

In other words, vertical movement of the second holding member 203 holding the lighting appliance 100 within the recessed portion 202*a* of the first holding member 201 due to vibration during transport or the like is restricted.

In a state in which the lighting appliance 100 is held by the second holding member 203, the first end portion 12*c* of the detachment member 12 is exposed from the notch 208 formed in the second holding member 203, as illustrated in FIG. 17.

By pulling the first end portion 12*c* of the detachment member 12 with a finger, for example, the claw portion 44 of the fitting adapter 40 can be pulled back, and the fitting adapter 40 can be removed from the hole 206 of the second holding member 203.

As a result, the lighting appliance 100 can be removed from the second holding member 203.

Figure 18:
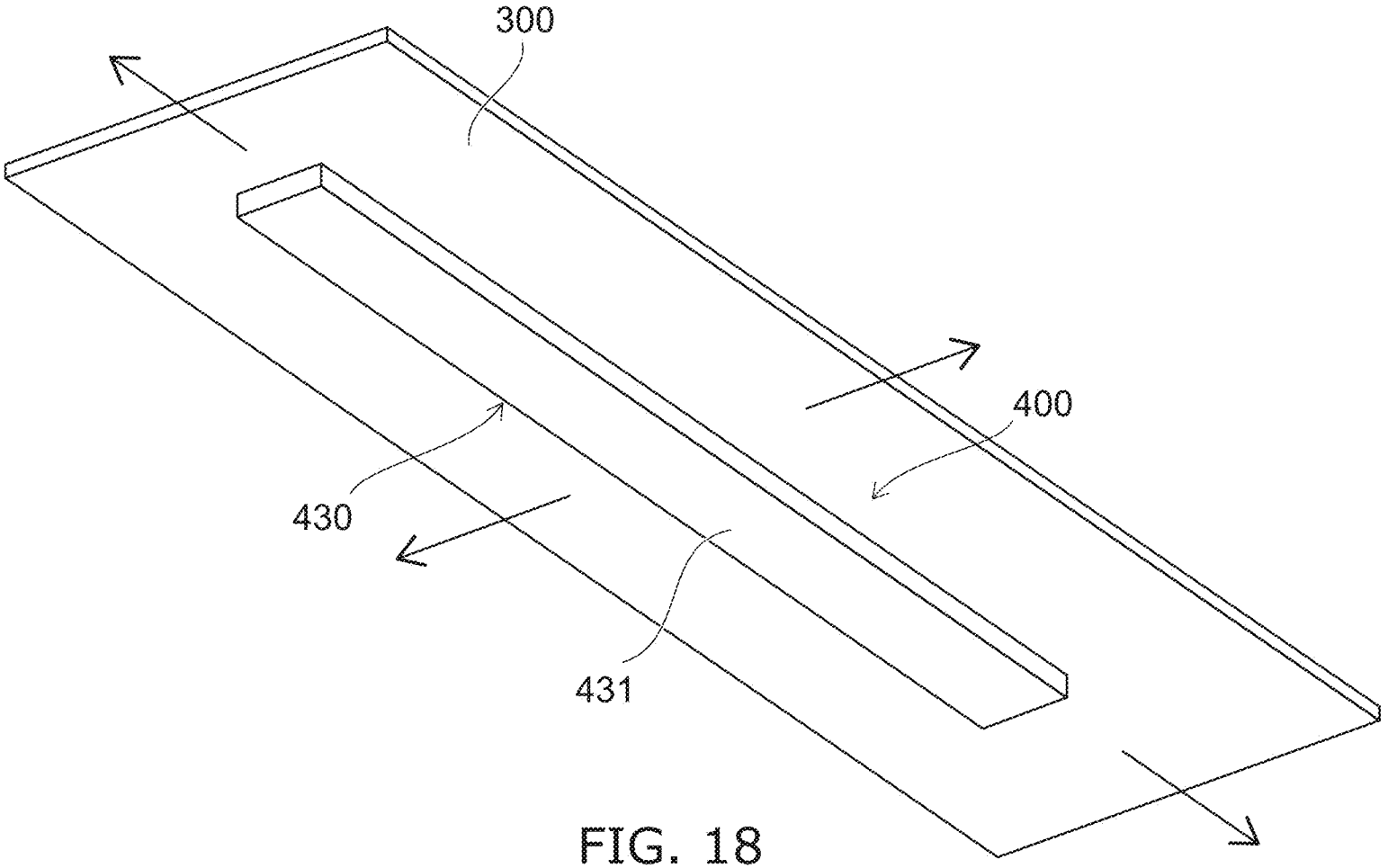
FIG. 18 is a perspective view illustrating a state in which a lighting appliance according to another embodiment is attached to a ceiling material.

FIG. 18 is a perspective view illustrating a state in which a lighting appliance 400 according to another embodiment is attached to the ceiling material 300.

Figure 19:
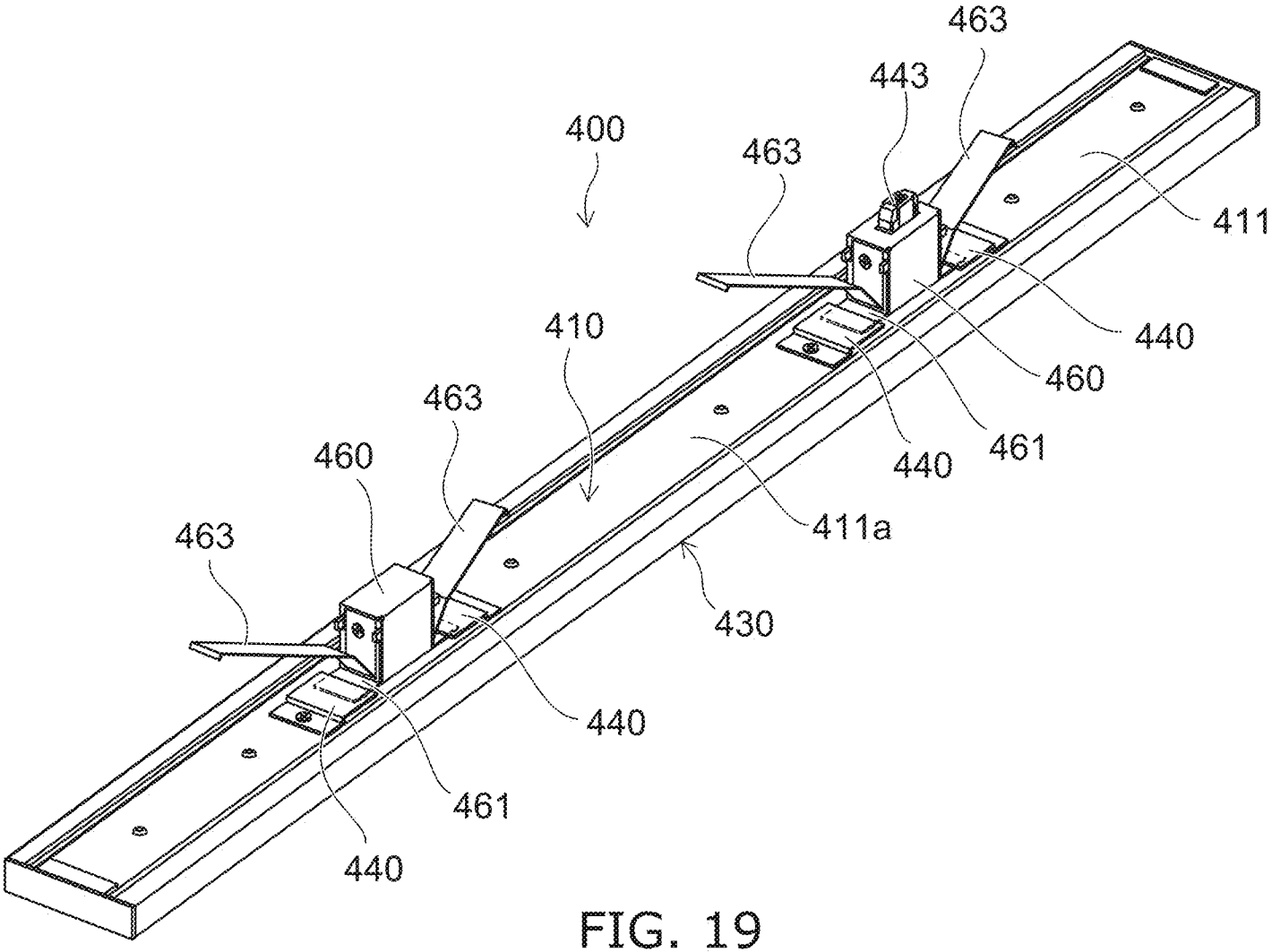
FIG. 19 is a perspective view of the rear side of the lighting appliance according to another embodiment.

FIG. 19 is a perspective view of the rear surface of the lighting appliance 400.

Figure 20:
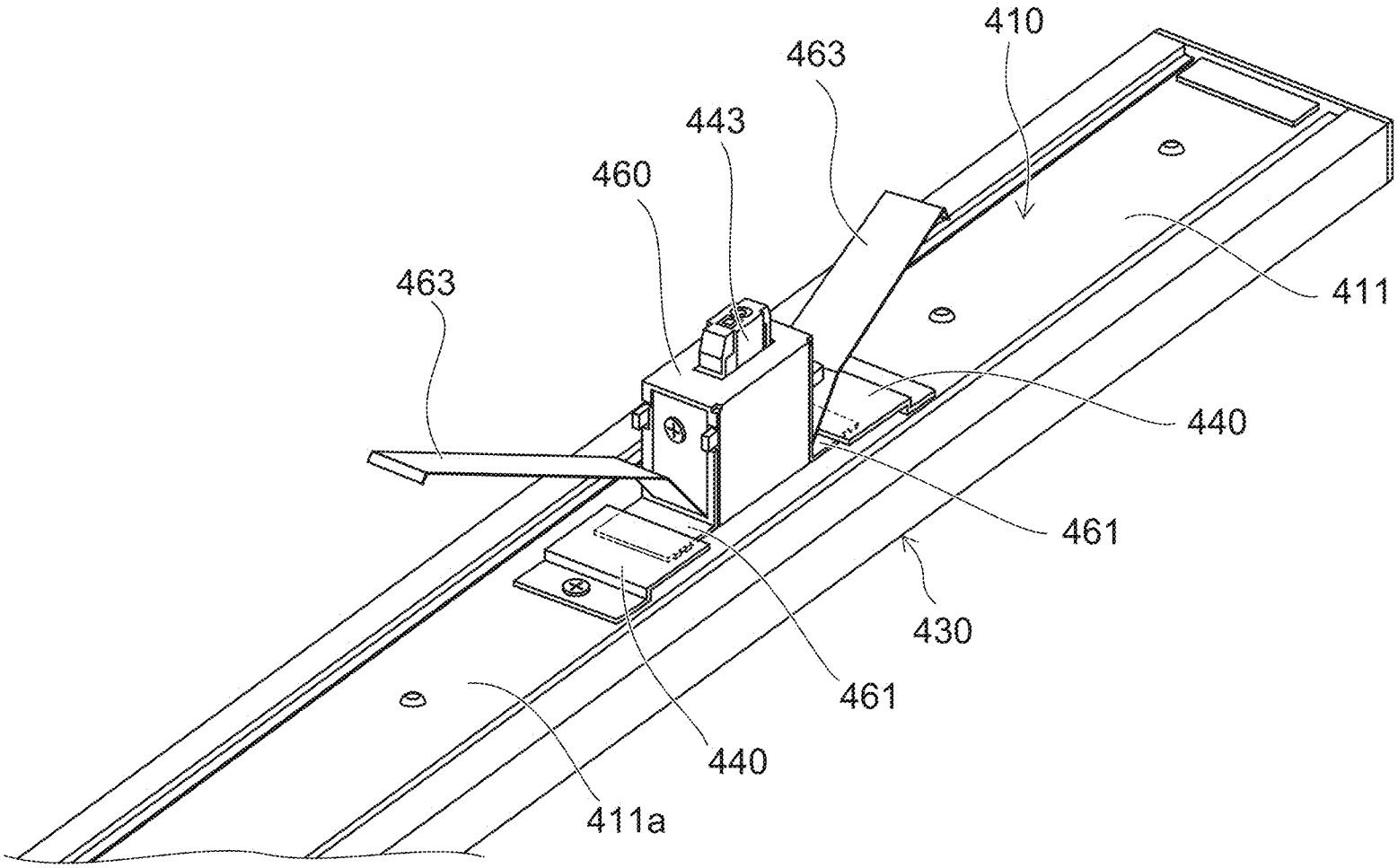
FIG. 20 is an enlarged perspective view of a portion of the lighting appliance illustrated in FIG. 19.

FIG. 20 is an enlarged perspective view of a part of the lighting appliance 400 illustrated in FIG. 19.

The outer shape of the lighting appliance 400 is formed into, for example, an elongated rectangular shape, and includes a rectangular light emitting surface 431.

The lighting appliance 400 includes a lighting appliance body 410, a light transmissive cover 430, and a mounting member 460.

The lighting appliance body 410 includes a rectangular plate-like base plate 411.

The mounting member 460 is provided on a rear surface 411*a* of the base plate 411.

For example, two mounting members 460 are provided spaced apart from each other in the longitudinal direction of the base plate 411 across the longitudinal center of the base plate 411.

A lighting appliance side connector 443 having a socket structure, for example, is fixed to the upper surface of one mounting member 460.

The lighting appliance body 410 includes a light source module 20 having a configuration similar to that of the light source module 20 described above with reference to FIG. 6.

The light source module 20 is mounted on a light source arrangement surface on a side opposite to the rear surface 411*a* of the base plate 411.

Similar to the embodiment described above, the light sources 22 can include the light emitting element 23 such as an LED, the phosphor layer 24, and the light transmissive resin member 25.

The lighting appliance side connector 443 illustrated in FIG. 19 and FIG. 20 is electrically connected to the light sources 22 through a conductor pattern formed in the substrate 21.

The cover 430 can transmit the light emitted by the light sources 22.

The cover 430 is formed, for example, in a milky white color having light diffusivity achieved by dispersing titanium oxide or the like in a resin material such as acrylic.

The cover 430 is supported by the lighting appliance body 410 so as to cover the light sources 22.

As illustrated in FIG. 19 and FIG. 20, a mounting spring 463 is fixed to the mounting member 460.

The mounting spring 463 is screwed to the mounting member 460, for example.

For example, two mounting springs 463 are fixed to one mounting member 460.

The two mounting springs 463 are positioned sandwiching the mounting member 460 in the longitudinal direction of the base plate 411.

The mounting member 460 includes two plate-like protruding portions 461.

The two protruding portions 461 are positioned sandwiching the mounting member 460 in the longitudinal direction of the base plate 411.

A holding member 440 is fixed to the rear surface 411*a* of the base plate 411.

Two holding members 440 are provided for one mounting member 460.

The two holding members 440 are positioned sandwiching the mounting member 460 in the longitudinal direction of the base plate 411.

One end portion of each of the holding members 440 on the side remote from the mounting member 460 is screwed, for example, to the base plate 411.

A portion of each of the holding members 440 that extends from a portion fixed to the base plate 411 toward the mounting member 460 is spaced apart from the rear surface 411*a* of the base plate 411 and overlaps the protruding portions 461 of the mounting member 460.

Each protruding portion 461 is disposed in a space between the holding member 440 and the rear surface 411*a* of the base plate 411.

Each protruding portion 461 is sandwiched between the holding member 440 and the rear surface 411*a* of the base plate 411, and the protruding portions 461 are not fixed to the base plate 411.

That is, the mounting member 460 and the mounting springs 463 fixed thereto are not fixed to the base plate 411.

The mounting springs 463 and the lighting appliance body 410 are movable relative to each other in a direction parallel to the rear surface 411*a* of the base plate 411.

This movement is not limited to linear movement and can also include rotational movement.

Prior to attaching the lighting appliance 400 to the ceiling material 300, the power supply unit 50 illustrated in FIG. 3 is disposed on the rear side of the ceiling material 300, similar to the embodiment described above.

Figure 21:
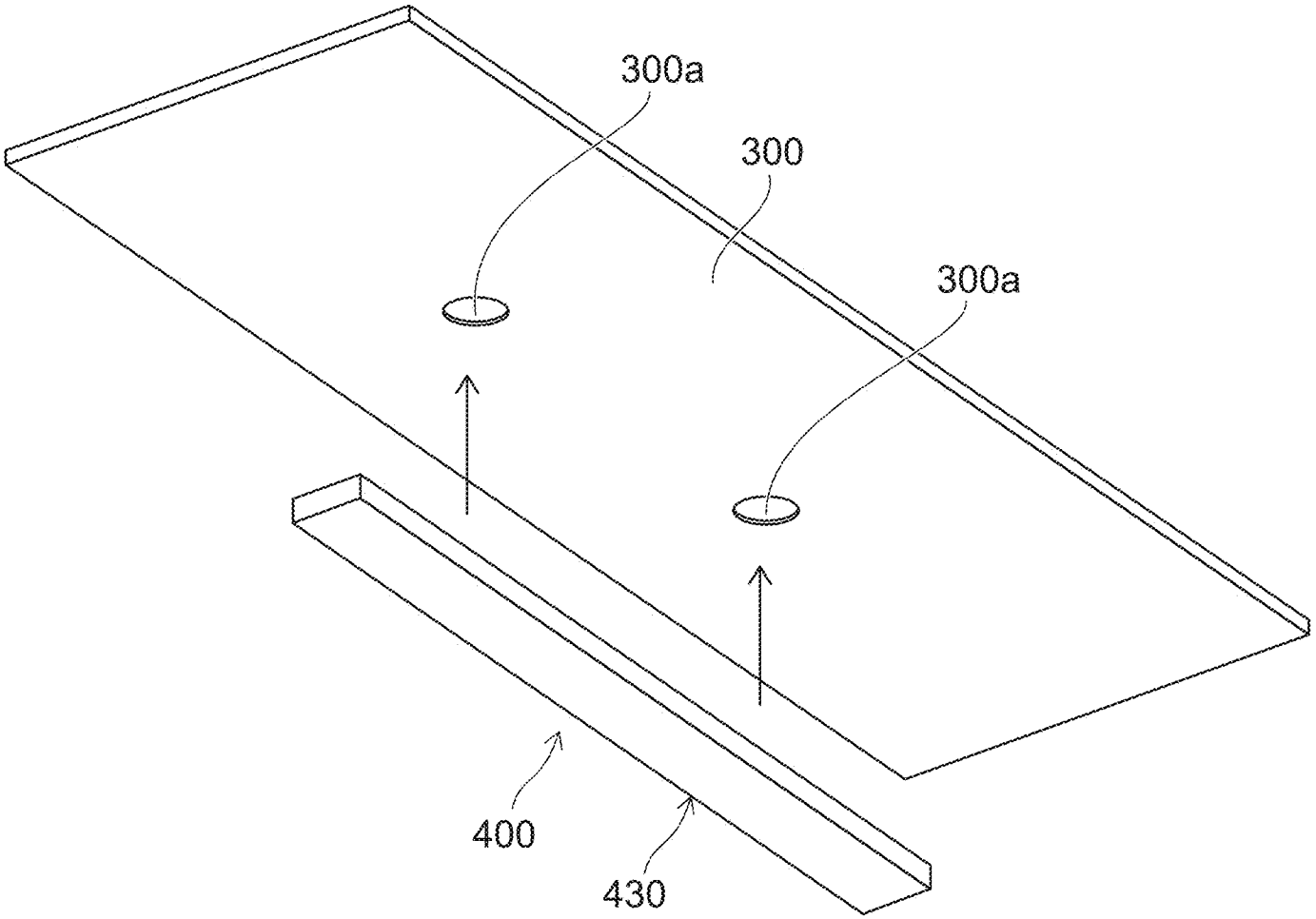
FIG. 21 is a perspective view of the lighting appliance and the ceiling material according to another embodiment.

The power supply unit 50 is passed from the mounting hole 300*a* formed in the ceiling material 300 illustrated in FIG. 21 to the rear side of the ceiling material 300 and is disposed at a position that does not overlap the mounting hole 300*a* on the rear side of the ceiling material 300.

In a case in which a power supply unit 50 is already installed on the rear side of the ceiling material 300 and is used as is, a power supply unit 50 need not be installed on the rear side of the ceiling material 300.

A worker that performs the mounting work of the lighting appliance 400 brings the lighting appliance 400 closer to the ceiling material 300 and holds the lighting appliance 400 with one hand while holding the power supply side connector Ma of the electrical cable 51 of the power supply unit 50 that hangs from the mounting hole 300*a* with the other hand.

Then, the worker connects the power supply side connector 51*a* to the lighting appliance side connector 443 fixed to the upper surface of the mounting member 460 provided on the rear surface of the lighting appliance body 410.

After the power supply side connector Ma is connected to the lighting appliance side connector 43, the mounting member 460 and the mounting springs 463 are placed on the rear side of the ceiling material 300 through the mounting hole 300*a*.

Then, the mounting springs 463 are disposed between a side surface of the mounting member 460 and the inner wall of the mounting hole 300*a* with the mounting springs 463 deformed from their natural state.

Restoring force of the mounting springs 463 acts on the mounting member 460 such that the mounting member 460 is fixed to the ceiling material 300 while being biased upward and the lighting appliance body 410 is attached to the ceiling material 300 so as to be pressed against the front side surface of the ceiling material 300.

Note that, similar to the embodiment described above, the lighting appliance 400 can also be attached to a wall material, not limited to the ceiling material 300.

The protruding portions 461 of the mounting member 460 fixed to the ceiling material 300 and the holding member 440 fixed to the lighting appliance body 410 are not fixed to each other and are movable relative to each other.

In other words, the lighting appliance body 410 is movable relative to the mounting member 460 fixed to the ceiling material 300.

Therefore, after mounting, in a case in which the position of the lighting appliance body 410 needs to be adjusted, the mounting position of the lighting appliance body 410 can be adjusted by sliding (also includes rotating) the lighting appliance body 410 in a direction along the mounting surface (ceiling surface) with respect to the mounting member 460 fixed to the ceiling material 300.

As a result, even if variations in the positions of a plurality of mounting holes 300*a* formed in the ceiling material 300 occur when arranging a plurality of lighting appliance main bodies 410 side by side, the plurality of lighting appliance main bodies 410, that is, the light emitting surfaces, can be evenly arranged seamlessly.

The material of the substrate 21 in the light source module 20 described above can include a resin material and/or a ceramic material.

Specific examples of the resin material of the substrate 21 include at least one type selected from the group consisting of phenol resin, epoxy resin, polyimide resin, BT resin, polyphthalamide (PPA), and polyethylene terephthalate (PET).

A substrate 21 formed from such a resin material is desirable not only from the perspective of insulating properties, but also from the perspective of low cost and ease of molding.

A substrate 21 formed from a resin material can be a substrate in which glass fibers and/or inorganic fillers (e.g., SiO2, TiO2, and Al2O3) are mixed with the resin material.

A resin material in which glass fibers and/or inorganic fillers are mixed improves the mechanical strength of the substrate 21, reduces the coefficient of thermal expansion, and improves light reflectance.

On the other hand, specific examples of the ceramic material of the substrate 21 include at least one type selected from the group consisting of alumina, mullite, forsterite, glass ceramic, nitride-based ceramic (e.g., AlN), and carbide-based ceramic (e.g., SiC).

A substrate 21 formed from such a ceramic material is particularly desirable because it is easier to achieve a light source module 20 having excellent heat resistance and light resistance.

By way of example only, the substrate 21 formed from a ceramic material can be made of alumina or a ceramic containing alumina as a main component.

In addition, a glass composite substrate represented by FR4 or the like, a glass epoxy substrate represented by CEM-3 or the like, a metal substrate represented by an aluminum substrate, a sapphire substrate, or a ruby substrate can be appropriately used as the substrate 21 depending on the application.

A semiconductor light emitting element such as a light emitting diode, can be used as the light emitting element 23.

The semiconductor light emitting element can include a light transmissive substrate and a semiconductor layered body formed on the light transmissive substrate.

For example, a light transmissive insulating material such as sapphire (Al2O3) or spinel (MgAl2O4), or a semiconductor material (e.g., a nitride-based semiconductor material) that transmits light emitted from the semiconductor layered body can be used as the light transmissive substrate.

The semiconductor layered body includes a plurality of semiconductor layers.

An example of a semiconductor layered body can include three semiconductor layers: a first conductive semiconductor layer (e.g., an n-type semiconductor layer), a light emitting layer (an active layer), and a second conductive semiconductor layer (e.g., a p-type semiconductor layer).

The semiconductor layer can be formed from a semiconductor material such as an III-V compound semiconductor or an II-VI compound semiconductor.

Specifically, a nitride-based semiconductor material such as InXAlYGa1−X−YN ($0 \leq X$, $0 \leq Y$, $X+Y \leq 1$) can be used (e.g., InN, MN, GaN, InGaN, AlGaN, InGaAlN, and the like).

The light emitting element 23 preferably has a light emission peak wavelength of 430 nm or greater and less than 490 nm.

The phosphor layer (wavelength conversion member) 24 can be a phosphor that absorbs light emitted from the light emitting element 23 and converts the light to light of a different wavelength.

For example, lutetium aluminum garnet (LAG) activated with cerium, nitrogen-containing calcium aluminosilicate (CaO-Al2O3-SiO2) phosphors activated with europium and/or chromium, silicate ((Sr, Ba)2SiO4) phosphors activated with europium, β SiAlON phosphors, nitride phosphors such as CASN or SCASN phosphors, KSF phosphors (K2SiF6:Mn), sulfide phosphors, 3.5 MgO.0.5 MgF2.GeO2:Mn4+, (Ca, Sr, Ba)8MgSi4O16 (F, Cl, Br)2:Eu, Si6-ZAlZN8-Z:Eu (0<Z<4.2), Ba3Si6O12N2:Eu, and the like.

The phosphor layer 24 can be, for example, a light emitting substance referred to as a so-called nanocrystal or quantum dot.

Examples of these materials include semiconductor materials, for example, II-VI, III-V, IV-VI semiconductors, specifically, nano-sized highly dispersed particles such as CdSe, core shell CdSXSe1−X/ZnS, GaP, and the like.

Figure 22:
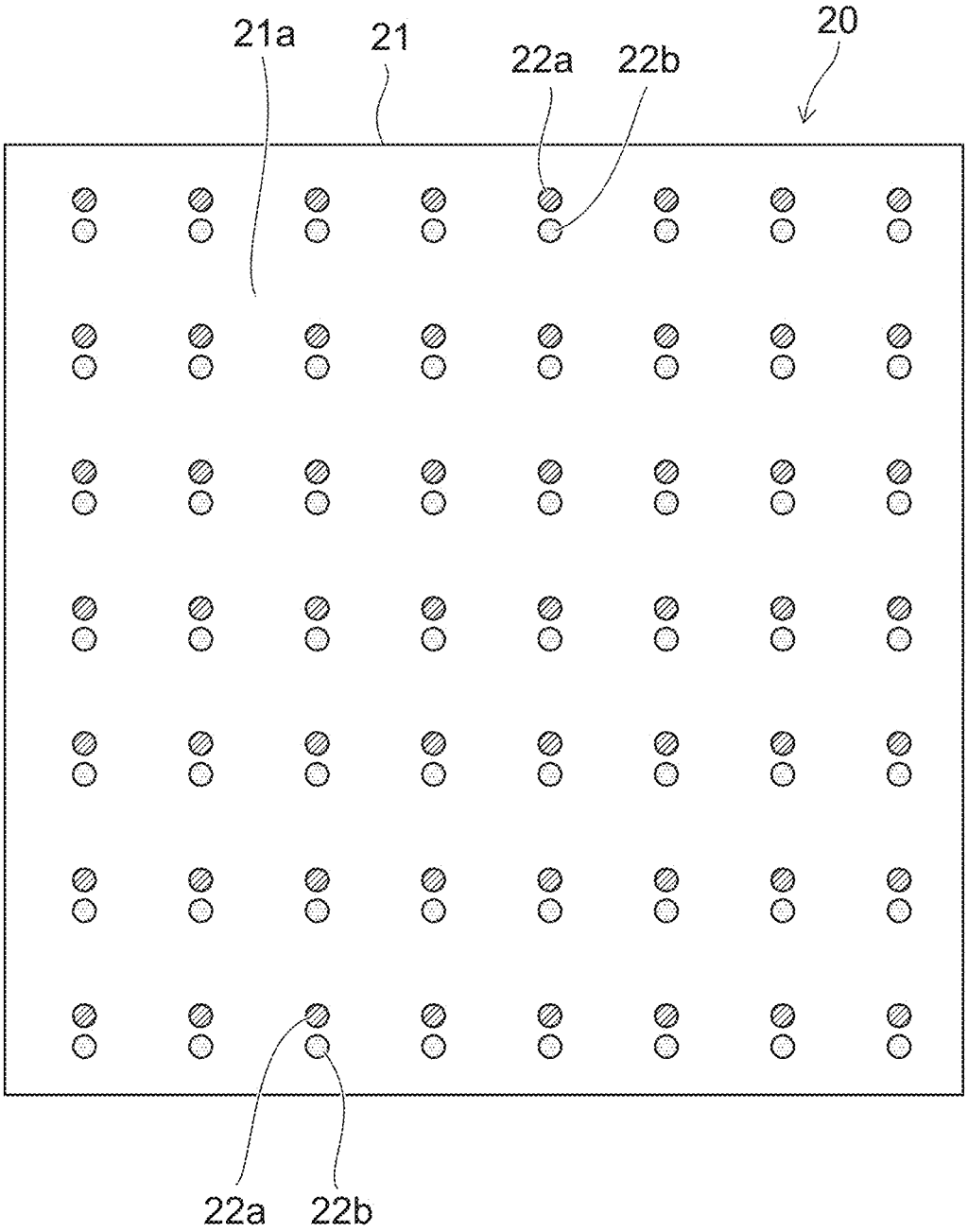
FIG. 22 is a plan view illustrating another example of a light source module according to the embodiment.

FIG. 22 is a plan view of another example of the light source module 20 according to the embodiment.

A plurality of first light sources 22*a* and a plurality of second light sources 22*b* are arranged periodically on the light source arrangement surface 21*a* of the substrate 21.

In FIG. 22, the first light sources 22*a* are represented by hatching, and the second light sources 22*b* are represented by a dot pattern.

Figure 23:
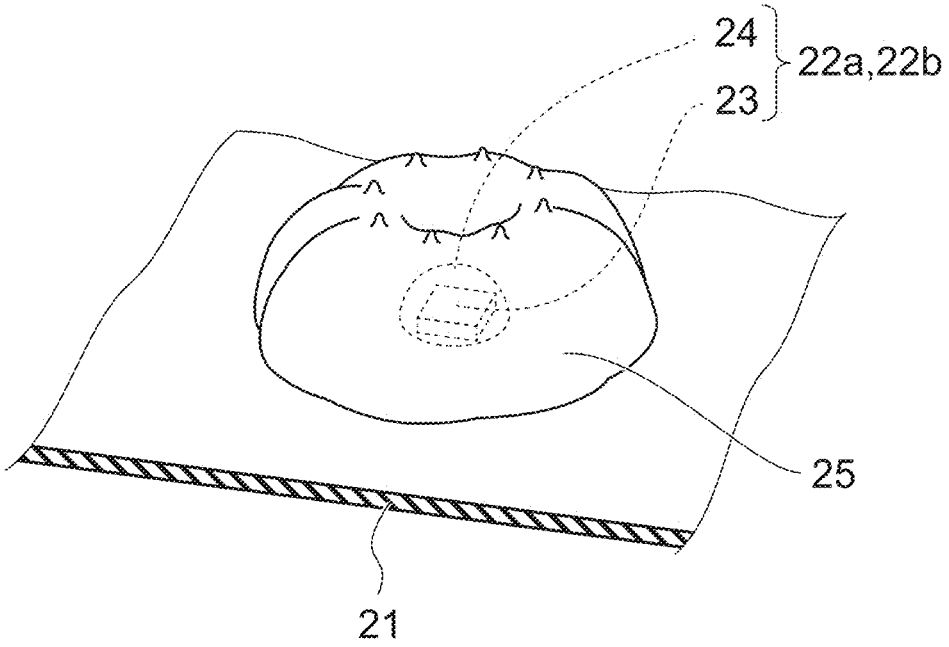
FIG. 23 is a schematic perspective view illustrating another example of a light source according to the embodiment.

FIG. 23 is a schematic perspective view of the first light source 22*a* and the second light source 22*b*.

Each of the first light source 22*a* and the second light source 22*b* includes the light emitting element 23, the phosphor layer 24, and the light transmissive resin member 25.

The phosphor layer 24 covers the light emitting element 23, and the resin member 25 covers the phosphor layer 24.

A portion of the resin member 25 that covers the vicinity of the center of the upper surface of the light emitting element 23 is recessed.

By having such a shape, the resin member 25 functions as a lens that affords the batwing light distribution characteristics described above to the light sources 22*a* and 22*b*.

The first light source 22*a* and the second light source 22*b* include the same elements, but emit white light having different correlated color temperatures from each other.

For example, the first light source 22*a* can emit white light at a correlated color temperature of 2700 K and the second light source 22*b* can emit white light at a correlated color temperature of 5000 K.

Adjusting these correlated temperatures and causing the light sources 21*a* and 21*b* to emit light allows the light source module 20 to emit white light of various correlated color temperatures.

As illustrated in FIG. 22, a plurality of sets of light sources including one first light source 22*a* and one second light source 22*b* disposed adjacent to each other in a first direction (vertical direction in FIG. 22) are provided.

The plurality of sets of light sources arranged in the first direction are electrically connected in series.

A plurality of sets of light sources arranged in a second direction (lateral direction in FIG. 22) orthogonal to the first direction have an electrically parallel relationship.

Next, as an embodiment, a step in which a lighting appliance 500, such as the lighting appliance 100 or the lighting appliance 400 described above, is installed during construction of a building such as an office building, a factory, or a commercial facility.

First, conventional steps in construction of such a building will be described.

Figure 24:
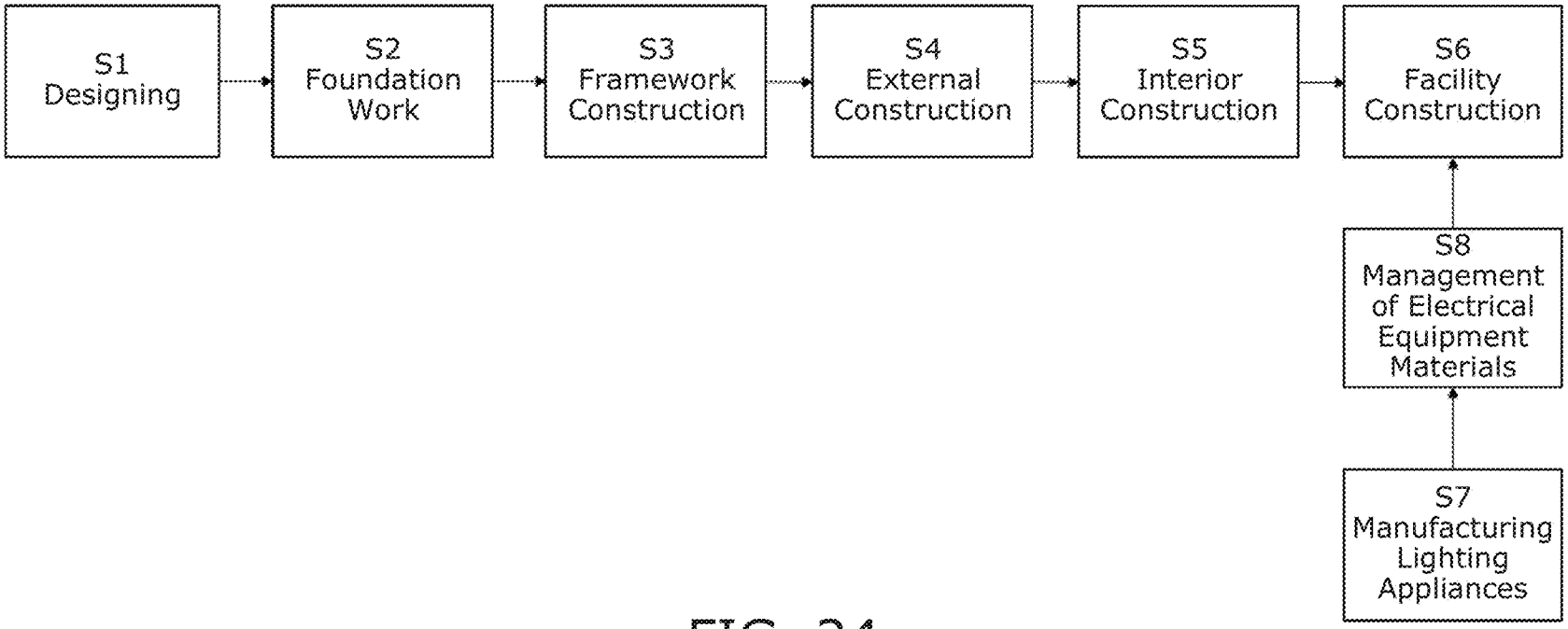
FIG. 24 is a flow diagram for describing the flow of lighting installation in steps until a building is constructed.

FIG. 24 is a flow diagram for describing the flow of lighting installation in steps until a conventional building is constructed.

Here, the present invention is targeted to buildings having a multi-floor structure and having corridors and rooms, such as a general office building.

In the construction of large scale buildings such as office buildings, a general constructor undertakes the order of constructive work and arranges all of the construction works performed by various kinds of agents.

First, a design architect or designer designs the building (step S1).

In this step, the layout of the corridors, the rooms, and the like are decided, and the overall design of the building is depicted in a design drawing.

The building materials to be employed and the electrical equipment materials such as lighting appliances are also determined to a certain degree, and the arrangement of these materials is also depicted in the drawings.

Next, based on the determined design, building materials and construction machinery are prepared, and the foundation work is performed (step S2).

In this step, a stable foundation that can withstand the load of the building is ensured by way of pile construction or earth construction.

Here, work is mainly performed by workers of agents performing civil engineering.

Note that the workers are not limited to workers of civil engineering agents, but workers of other agents work as well.

Next, structural construction of forming the structural body of the building on the stable foundation is performed (step S3).

In a case in which the building includes a base part or a basement floor, the structural construction begins with subterranean construction, such as construction of the basement floor, and advances to the ground floor.

Concrete casting, positioning of piles, steel frame assembly, and the like are performed to complete the overall framework of the building.

Concrete is also poured onto the outer walls, roof, floor of each story, and the like.

During the structural construction, an insert is embedded in order to hang hanging bolts used in the subsequent interior construction.

For example, a ceiling insert used for fixing a hanging bolt is fixed as part of a slab when a floor slab (such as a reinforced concrete flooring) of the upper floor is cast.

Here, work is mainly performed by workers of agents performing civil engineering, and workers of agents performing steeplejack work, earthwork and concrete construction.

Next, the external construction of the building is performed (step S4).

The outer walls are tiled, and window sashes, window glass, curtain walls, and the like are attached.

Painting or the like is also performed.

Next, interior construction is performed (step S5).

During interior construction, the ceiling, walls, and floors are built up.

When performing ceiling construction for installing a ceiling, a ceiling material, which is a member that configures a ceiling surface such as a ceiling board or a ceiling base material, is attached to a base of combined lightweight steel frame materials, with the hanging bolt hanging from the ceiling insert provided in the structural construction of step S3.

Hanging materials such as hanging bolts and hangers and diagonal members are used to support the ceiling material, which prevents the ceiling board from falling out.

For example, in Japan, provisions for preventing a ceiling from falling are stipulated in the Building Standard Act, Enforcement Order, and the like.

Among these standards, one standard states that falling prevention measures such as securing the ceiling by using a hanging material be performed when a ceiling material satisfying a predetermined condition is used.

Depending on size, weight, and other factors, some lighting appliances can be installed on a ceiling without being fixed by a hanging material, and some lighting appliances are fixed by using a hanging material.

Note that instead of installing the ceiling inserts used for fixing the hanging bolts during concrete casting, the hanging bolts can be fixed by fixing an anchor to the concrete after casting.

However, in consideration of efficiency and safety, it is preferable that the ceiling insert be disposed in advance, and for locations where it is known that hanging materials will be provided, it is preferable that the position of the ceiling insert be determined at the design stage and the ceiling insert be embedded during concrete casting.

During interior construction, before the ceiling is finished, that is, before the ceiling is formed by the ceiling material, work is also performed of suspending ducts and air conditioning ducts, and wires and the like are passed into the ducts.

Therefore, space necessary for installing electrical wiring, ducts, air conditioning devices, and the like is provided on the rear of the ceiling.

Furthermore, an opening is provided in the ceiling material according to the locations where lighting or air conditioning is installed.

Here, the work of installing ducts in the ceiling and securing the ceiling material by using the hanging material is performed by workers of agents that perform interior construction.

On the other hand, the work of providing the electrical wiring is carried out by specialized workers that can perform electrical work due to danger of electric shocks and the like.

It is assumed that the workers performing ceiling construction in which the ceiling is installed and the workers performing wiring work in which the electrical wiring is passed through the rear of the ceiling are often different workers.

Note that in Japan, electric construction such as wiring work is not permitted to be performed by a person not having electric construction credentials.

Thus, when constructing buildings, one needs to consider the safety of workers that are dispatched from a variety of professional agents, each of which performs specialized tasks.

In the present specification, a worker who prepares the ceiling material for construction of a building and performs ceiling construction is referred to as a ceiling installation worker.

A worker who prepares electrical wiring for construction of a building and performs wiring work is referred to as a wiring construction worker.

Note that the construction described in each of the steps for construction of a building is typically performed by a plurality of workers.

Therefore, a ceiling installation worker is not limited to a single worker and refers to one or more workers who perform ceiling construction when constructing buildings.

The same applies to the wiring construction worker and other workers.

Next, when interior construction is completed and the floors, walls, and ceilings are finished, installation work is performed (step S6).

In the installation work, equipment that is required when actually using the building is installed.

For example, facilities for electricity, gas, water supply, water discharge, air conditioning, toilets, disaster prevention, broadcasting, and the like, and facilities for lighting, escalators, elevators, and the like are installed.

This works is performed by workers of agents such as electric construction, electrical communication construction, water supply facility construction, fire extinguishing facility construction, and cleaning facility construction.

The installation work for lighting needs to be carried out by a worker having electric construction credentials because lighting appliances need to be electrically connected.

Note that the position where the lighting is installed is not limited to a ceiling, but lighting appliances installed on the ceiling are usually connected to the wiring provided on the rear of the ceiling and electrically connected to each other by a worker having electric construction credentials.

Even in a case in which an air conditioning device is installed in the ceiling during facility construction for air conditioning, the air conditioning device is connected to the wiring provided on the rear of the ceiling by the worker having electric construction credentials.

Typically, in a room of a building such as an office building, a large lighting appliance or air conditioning device disposed in a ceiling is fixed by using a hanging material.

Therefore, a worker that performs the installation work of such a large lighting appliance or air conditioning device can also perform work of fixing the large lighting appliance or air conditioning device on a hanging material suspended from a ceiling insert and installing the large lighting appliance or air conditioning device in the ceiling.

The manufacturer of the lighting appliances manufactures lighting appliances necessary for construction and delivers these appliances to an electrical material commercial company that manages electrical equipment materials, so as to ensure that the installation work of the lighting is completed on time (step S7).

The electrical material company manages the stock of materials of not only lighting appliances but also switches, outlets, wires, cables, power distribution boards, and antennas, and materials such as switch boards, interphones, and fire detectors, and supplies the required electrical equipment materials required for construction in the required amount (step S8).

In the present specification, an employee of an agent that manufactures lighting appliances or delivers lighting appliances is referred to as a lighting appliance supplier.

Note that in the step of installation work, the installation work of the lighting is performed separately from the installation work of the air conditioning.

Note that both of these installation works can be performed simultaneously or by the same person, but it is common to share work in consideration of work efficiency.

In this way, the building is constructed.

Note that in the present specification, the term "worker for installation work" is intended to refer to one or more workers who perform installation works for lighting or air conditioning, and can include a case in which the installation work for lighting and air conditioning is performed by the same person as described above.

On the other hand, the term "worker for installation work of lighting" is intended to refer to one or more workers who perform installation work for lighting, and refer to workers who do not perform installation work for air conditioning.

The term "worker for the installation of air conditioning" is intended to refer to one or more workers who perform installation work for air conditioning, and refers to workers who do not perform installation work for lighting.

Next, as an embodiment, a step for constructing a building and a step for installing the lighting appliance 500 in this construction will be described.

For the lighting appliance 500, the lighting appliance 100 or the lighting appliance 400 described in the embodiments above can be used.

A building 510 according to the present embodiment has a multi-floor structure and includes corridors and rooms.

Note that the building 510 can be a one-floor structure.

Figure 25:
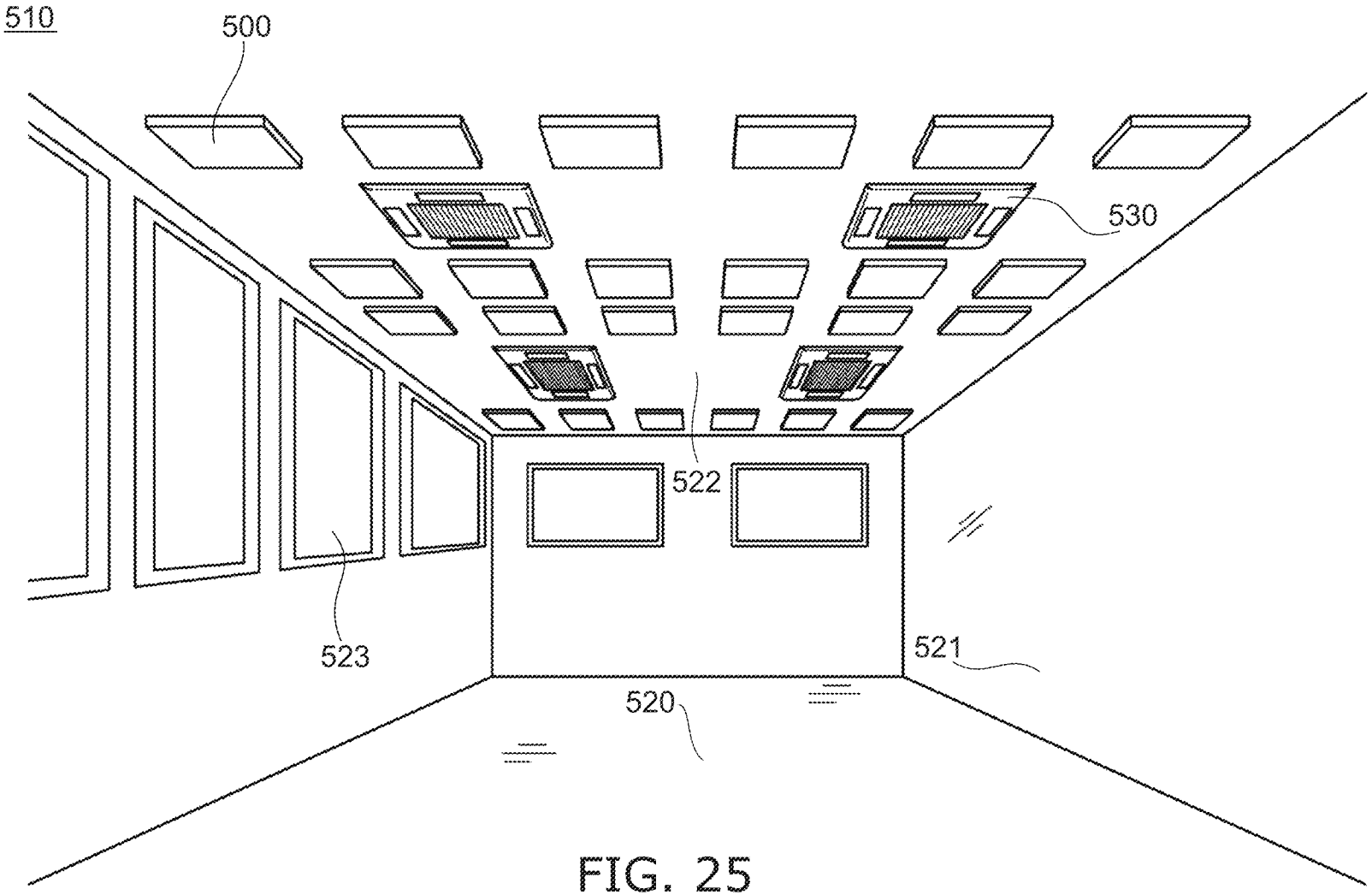
FIG. 25 is a schematic view illustrating an example of a structure of a room in a building according to an embodiment.
Figure 26:
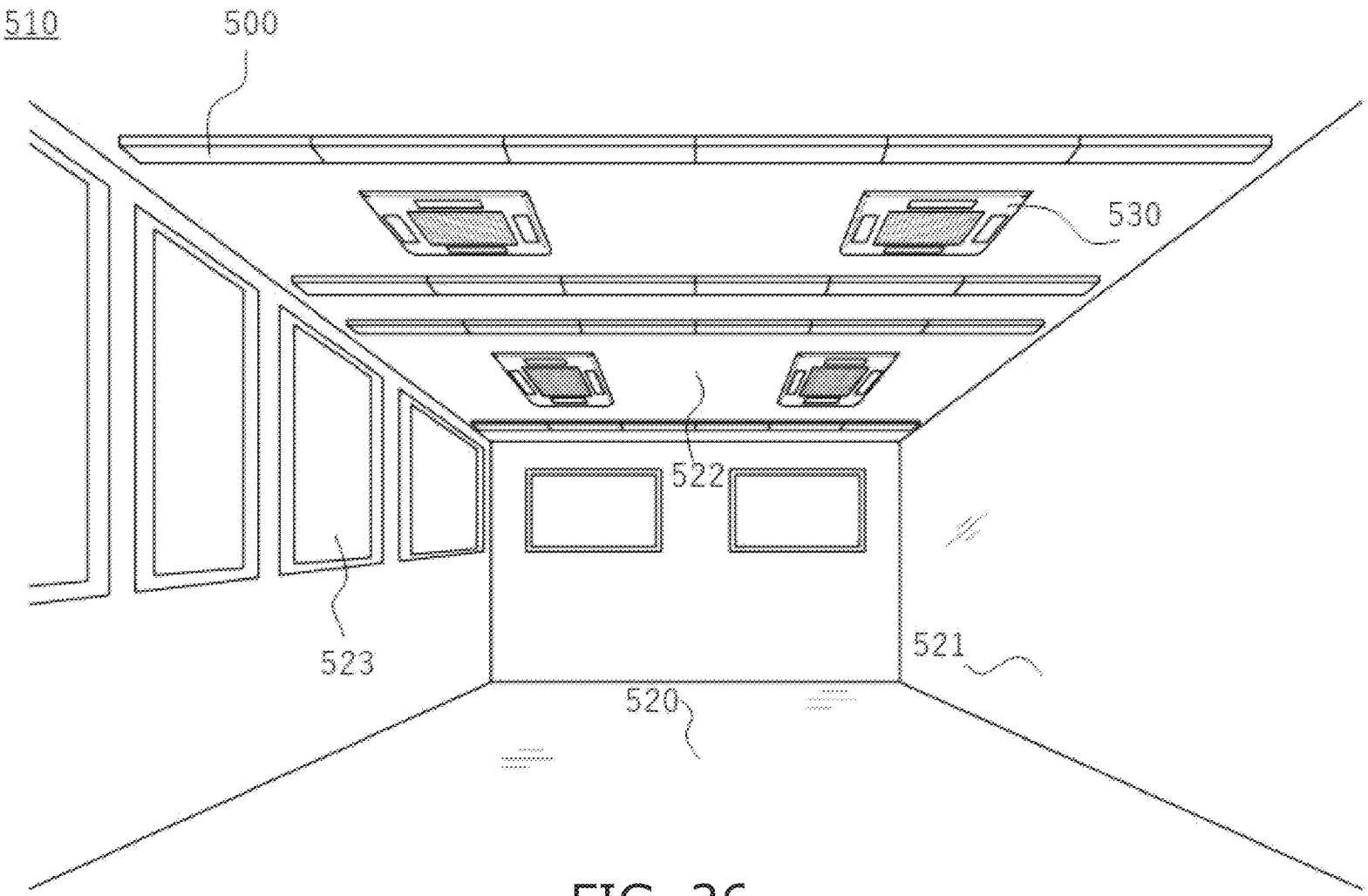
FIG. 26 is a schematic view illustrating another example of a structure of a room in a building according to the embodiment.

FIGS. 25 and 26 are schematic diagrams illustrating an example of a structure of a room on a specific floor of the building 510.

In the building 510, a floor 520, walls 521, a ceiling 522, and windows 523 form a room space.

Note that the side surfaces of the room can be formed of only the walls 521 without the windows 523.

A plurality of the lighting appliances 500 and a plurality of air conditioning devices 530 are installed in the ceiling.

Note that a single air conditioning device 530 can be used.

Here, ceiling installation instruments for a lighting appliance or air conditioning device installed in a ceiling can include those which are necessary or not necessary to be fixed directly by a hanging material.

As an example, a small ceiling installation instrument such as a monitoring camera, a downlight, an emergency light, or a smoke detector is installed without being fixed by being directly connected to a hanging material such as a hanging bolt or a diagonal member.

Such a small ceiling installation instrument is allowed to be installed without using a hanging material because the load applied to the ceiling material is small.

Hereinafter, such a ceiling installation instrument is referred to as a ceiling installation instrument that does not need to be fixed by a hanging material.

On the other hand, ceiling surface mounted base lighting, ceiling embedded base lighting, the air conditioning device 530, and the like are installed in a fixed manner by being directly connected to a hanging material.

Such a ceiling installation instrument applies a large load to the ceiling material, and thus poses an increased risk of falling off if, for example, an earthquake occurs and the ceiling installation instrument is not fixed by a hanging material.

Thus, the ceiling installation instrument itself is supported by a hanging material without employing an installation configuration in which all loads are applied to the ceiling material.

Hereinafter, such a ceiling installation instrument is referred to as a ceiling installation instrument that needs to be fixed by a hanging material.

For example, in a case of a building such as an office building, it is conceivable that small ceiling installation instruments such as downlights are provided for lighting a narrow space such as a corridor, and a large lighting appliance such as base lighting is provided across a wide space such as a room.

Small lighting appliances can be provided in parts of the room, but the majority of lighting appliances installed in the entire room are large lighting appliances.

The lighting appliance 500 according to the present embodiment has features corresponding to base lighting as features of the lighting appliance, and can be a lighting appliance that does not need to be fixed by a hanging material during lighting installation work.

In other words, the lighting appliance 500 is a lightweight large lighting appliance that is large enough to be handled as a base lighting equivalent product while being lightweight so that a hanging material is not required.

Here, the lightweight large lighting appliance in the present specification refers to a lighting appliance that meets at least one of the following requirements: total luminous flux is equal to or greater than 2500 lm; area of the light emitting surface, which is the surface closest to the floor, is equal to or greater than 45000 mm2, and 100 or more light source elements are disposed.

Alternatively, in addition to this, the characteristics of the lightweight large lighting appliance can be further specified by a condition that the weight of the lighting appliance is 0.5 kg or greater and less than 2.5 kg.

The lighting appliance 500, which is a lightweight large lighting appliance, can be, for example, a lighting appliance having a height of 450 mm, a width of 450 mm, and a height of 20 mm from the ceiling installation surface to the light emitting surface, with the light emitting surface having a square shape.

The light emitting surface of the lighting appliance can also be a square shape with a length of 600 mm and a width of 600 mm.

The light emitting surface of the lighting appliance can be a rectangular shape having a length of 150 mm and a width of 600 mm, or can be a rectangular shape having a length of 75 mm and a width of 600 mm.

In this manner, designing the length of the lighting appliance in the vertical and horizontal directions as 600 mm or as the length of 600 mm divided by a natural number makes the lighting appliance more compatible with the ceiling material 300.

In building codes in Japan, building materials such as ceiling materials are treated on a shaku basis, and the length of ceiling materials in the vertical and horizontal directions is designed based on approximately 300 mm units.

Therefore, matching the vertical and lateral widths of the lighting appliance 500 to the vertical and lateral widths of the ceiling material 300 facilitates installation even in a case in which the lighting appliances 500 are arranged side by side.

The lighting appliance 500 that does not need to be fixed by a hanging material places the load of the lighting appliance 500 on the ceiling material 300.

Therefore, it is desirable to install one lighting appliance 500 in one ceiling material 300.

In consideration of balancing the load, it is desirable that the center of gravity of the lighting appliance 500 be centered on the ceiling material 300.

Aligning the vertical and horizontal dimensions of the lighting appliance 500 to the vertical and horizontal dimensions of the ceiling material in accordance with the standards of the building materials makes it easier to achieve a design that satisfies these installation conditions.

In particular, as illustrated in FIG. 26, in a case in which the lighting appliances 500 are installed in a coupled manner, if the vertical or horizontal dimensions of the lighting appliance 500 do not match the vertical or horizontal dimensions of the ceiling material, the installation locations of the lighting appliances 500 in adjacent ceiling materials 300 differ from each other.

A larger number of couplings results in worse balance of load because offset is chained in the direction in which the lighting appliances 500 are connected.

Next, steps until the lighting appliance 500 is installed in construction of the building 510 will be described.

Note that points different from the steps until the construction of the building described above with reference to FIG. 24 will be described in detail, and the description of overlapping points will be simplified or omitted.

Because the lighting appliance 500 need not be fixed by a hanging material 570, in step S1, the design architect or designer need not determine the placement position of the hanging material for the installation position of the lighting appliance 500.

In a case in which the installation position of the base lighting that needs to be fixed by a conventional hanging material is changed after the ceiling insert is provided and the placement position of the hanging material 570 is determined, a new hanging bolt needs to be installed.

However, there is no need for when using the lighting appliance 500.

Thus, the design architect or designer can flexibly change the installation position of the lighting appliance 500 even after construction has proceeded to some degree.

Steps from step S2 to step S4 are generally similar to those described above.

Next, in the interior construction of step S5, ceiling construction is performed in which a ceiling is provided.

The wiring disposed on the rear of the ceiling is passed to a position higher than the ceiling before the ceiling is finished or after the ceiling is finished.

Figure 27:
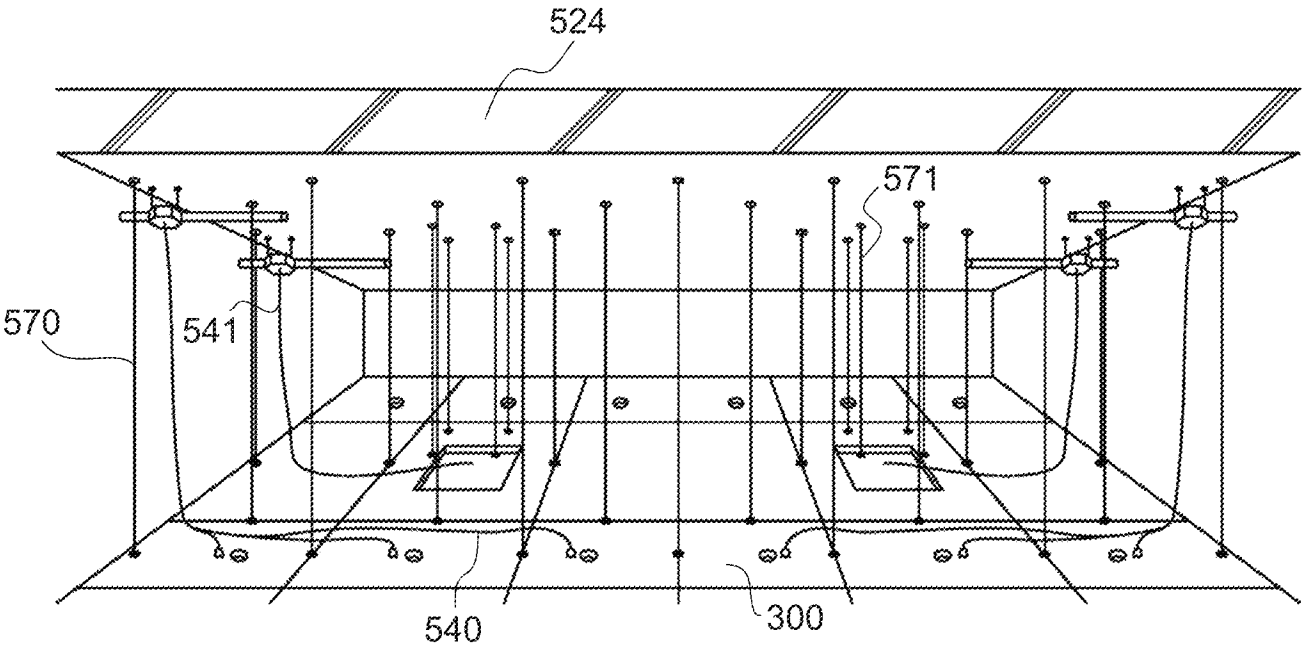
FIG. 27 is a schematic diagram illustrating a structure of a ceiling rear space in construction of the building according to the embodiment.

FIG. 27 illustrates an example of the rear of a ceiling in a state in which ceiling construction has been performed.

As illustrated in FIG. 27, the rear of the ceiling includes a space in which the upper surface and the side surfaces of the ceiling are formed by a structural body 524 where concrete is cast, and the lower surface of the ceiling is formed by the ceiling 522 where the ceiling material 300 is disposed.

Each piece of ceiling material 300 that forms the ceiling 522 is fixed and supported by the hanging material 570 connected to a ceiling insert of the structural body.

Note that, the hanging material 570 is partially omitted in FIG. 27 to simplify the drawing.

The space on the rear of the ceiling includes wiring 540 and wiring 541 provided through ducts.

The wiring is provided based on the design drawing according to the number of installed electrical connection devices such as lighting or air conditioning installed in the ceiling back.

After sufficient wiring is provided for supplying power to the electrical connection devices, the ceiling 522 is provided.

Here, the work of passing wiring in the rear of the ceiling is performed by a wiring construction worker having electric construction credentials.

In this work, for the wiring 540 to be connected to the lighting appliance 500, a connector is provided by the wiring construction worker having electric construction credentials.

This connector is an example of an electric shock prevention connection instrument used for preventing electric shocks in connection work between an electrical connection instrument and the wiring 540 for electrically connecting the electrical connection instrument.

With an electric shock prevention connection instrument such as a connector, the work of connecting the wiring 540 to the lighting appliance 500 can be performed without a person having electric construction credentials.

In the example of FIG. 27, a connector is provided for the wiring 540 to be connected to the lighting appliance 500, while an electric shock prevention connection instrument such as a connector is not provided for the wiring 541 to be connected to the air conditioning device 530.

Therefore, in order to comply with the legislation of Japan at the time of filing, the work of connecting the wiring 541 to the air conditioning device 530 needs to be performed by a person having electric construction credentials.

Note that, the wiring 540 is partially omitted in FIG. 27 to simplify the drawing.

In this manner, in the work of providing the wiring disposed on the ceiling back, work is performed of installing, among a plurality of wiring disposed on the ceiling back, the wiring 540 provided with an electric shock prevention connection instrument such as a connector as wiring for electrical connection to the lighting appliance 500 that is not fixed by a hanging material when installed in the ceiling.

Because the air conditioning device 530 is to be fixed by a hanging material, a hanging material 571 is provided as the hanging material for fixing the air conditioning device 530.

At the point in time illustrated in FIG. 27, the air conditioning device 530 is not yet attached, and so the hanging material 571 does not fix the air conditioning device 530.

An opening is provided in the ceiling material 300 for installing a ceiling installation instrument, such as the air conditioning device 530 and the lighting appliance 500.

The square opening illustrated in FIG. 27 is an opening for the air conditioning device 530.

The circular opening illustrated in FIG. 27 is the mounting hole 300*a* for the lighting appliance 500.

In the example of FIG. 27, among 6*3, total of 18, ceiling materials 300, an opening for installing the air conditioning device 530 is provided in each of two ceiling materials 300, and an opening for installing the lighting appliance 500 is provided in each of 12 ceiling materials 300.

As illustrated in FIG. 27, the mounting hole 300*a* provided for installing the lighting appliance 500 is smaller than the ceiling material 300.

The opening is also sufficiently smaller than the light emitting surface of the lighting appliance 500.

In contrast, downlights and emergency lighting include an opening equivalent to the size of the lighting appliance.

In the lighting appliance 500, the size of the mounting hole 300*a* can be set to ⅓ or less than the area of the light emitting surface.

Alternatively, the size of the mounting hole 300*a* can be set to ⅕ or less than this area.

Alternatively, the size of the mounting hole 300*a* can be set to 1/10 or less than this area.

The mounting hole 300*a* for installing the lighting appliance 500 is formed, for example, into a circular shape with a diameter in a range of 10 cm to 15 cm.

The shape of the mounting hole 300*a* can be not circular, and can have a polygonal shape with a maximum diameter of 15 cm or less.

The shape of the mounting hole 300*a* can be determined based on the size and shape of the power supply adapter 550 or other factors.

Note that in order to attach the lighting appliance 500, it is preferable that the mounting hole 300*a* be sized so that the arm of a worker can pass through the mounting hole 300*a* to take the wiring 540 from the room side by hand.

Note that the ceiling material 300 need not be provided with an opening in advance.

It is common to prepare a ceiling material 300 without an opening and have a worker form an opening by creating a hole in the ceiling material 300 at the site where the interior construction is performed.

The work of forming an opening in a ceiling material 300 with no opening can be performed as appropriate.

The shape of the opening to be prepared can also vary depending on how the ceiling installation instrument is installed.

Thus, the opening can be formed when the ceiling material 300 is fixed by the hanging material 570 and attached to the ceiling, or can be provided after the ceiling is formed.

After the ceiling 522 is provided in this manner, the installation work of lighting is performed in the facility construction of step S6.

Figure 28:
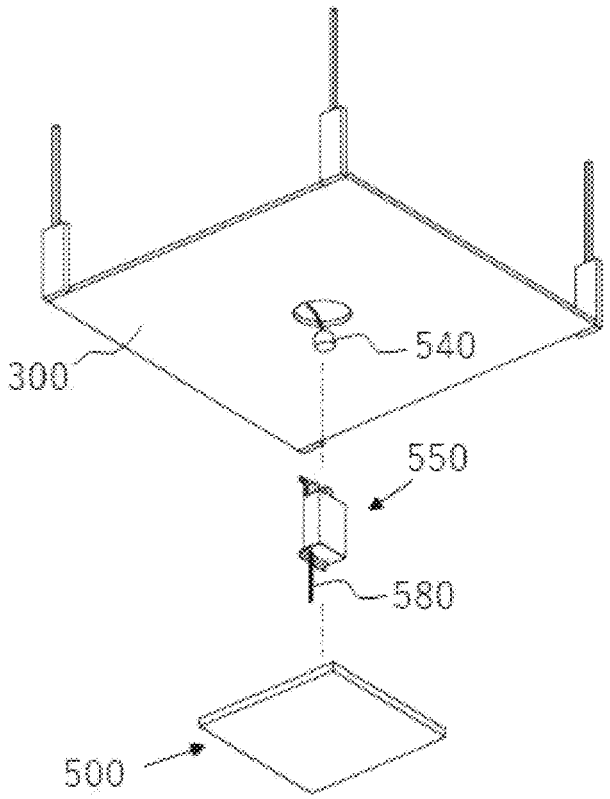
FIG. 28 is a schematic diagram for describing a method of installing a lighting appliance according to the embodiment.

FIG. 28 is a schematic diagram illustrating the connection relationship between the wiring with a connector 540, the ceiling material 300, a power supply adapter 550, and the lighting appliance 500.

Note that the installation work of lighting can be performed even by a person who does not have electric construction credentials.

Note that when the ceiling 522 is provided in the building 510, the room space, which is the space that forms the room illustrated in FIG. 25, and the ceiling rear space, which is the space that forms the rear of the ceiling illustrated in FIG. 27, can be regarded as distinct spaces.

Here, the presence or absence of the opening in the ceiling material 300 is not considered.

Specifically, in a case in which a ceiling material 300 that does not include an opening is used to form the ceiling 522 in the building 510, the space located above the ceiling 522 and including the ceiling 522 as a portion forming the space is distinguished as the ceiling rear space, and the space located below the ceiling 522 and including the ceiling 522 as a portion forming the space is distinguished as the room space.

First, the lighting appliance 500 and the power supply adapter 550 are provided in the room space by a worker present in the room space.

The lighting appliance 500 is packaged and delivered in the packing material described in FIGS. 16 and 17, for example.

The lighting appliance 500 is connected to the power supply adapter 550 by a worker present in the room space through fitting the mounting adapter of the lighting appliance 500 into the power supply adapter 550.

The lighting appliance 500 connects with a DC harness 580 of the power supply adapter 550 to be powered by DC power supply from the power supply adapter 550.

For example, a DC voltage of 100 V is supplied.

The connection to the DC harness 580 can also be performed by a worker that does not have electric construction credentials.

Note that the fitting adapter 40 and the mounting member 460 correspond to one form of the mounting adapter.

The power supply unit 50 corresponds to one form of the power supply adapter 550.

The electrical cable 51 corresponds to one form of the DC harness 580.

Note that because AC power supply is supplied via the wiring 540, the power supply adapter 550 has an AC/DC conversion function.

The power supply adapter 550 includes an AC terminal stand 560 as a connection portion for electrically connecting to the wiring with a connector 540 via a connector.

The worker present in the room space passes an arm through the opening and pulls the wiring with a connector 540 provided in the ceiling rear space from the opening and pulls the wiring 540 into the room space.

Then, the connector of the wiring with a connector 540 and the AC terminal stand 560 are connected in the room space.

Note that the terminal stands 52 and 53 correspond to one form of the AC terminal stand.

Note that for a case in which the lighting appliance 500 has a lighting control function that adjusts the intensity and/or tone of light emission, the power supply adapter 550 includes a lighting control terminal stand as a connection portion for connecting to a lighting control driver device that controls the lighting control.

In a case in which a lighting appliance 500 is used that does not have a lighting control function, lighting control terminal stands are not needed.

In this way, work is performed to connect the wiring with a connector 540 disposed in the ceiling rear space above the formed ceiling 522 and the power supply adapter 550 by using a connector of the wiring with a connector via the opening provided in the ceiling material 300.

Figure 29:
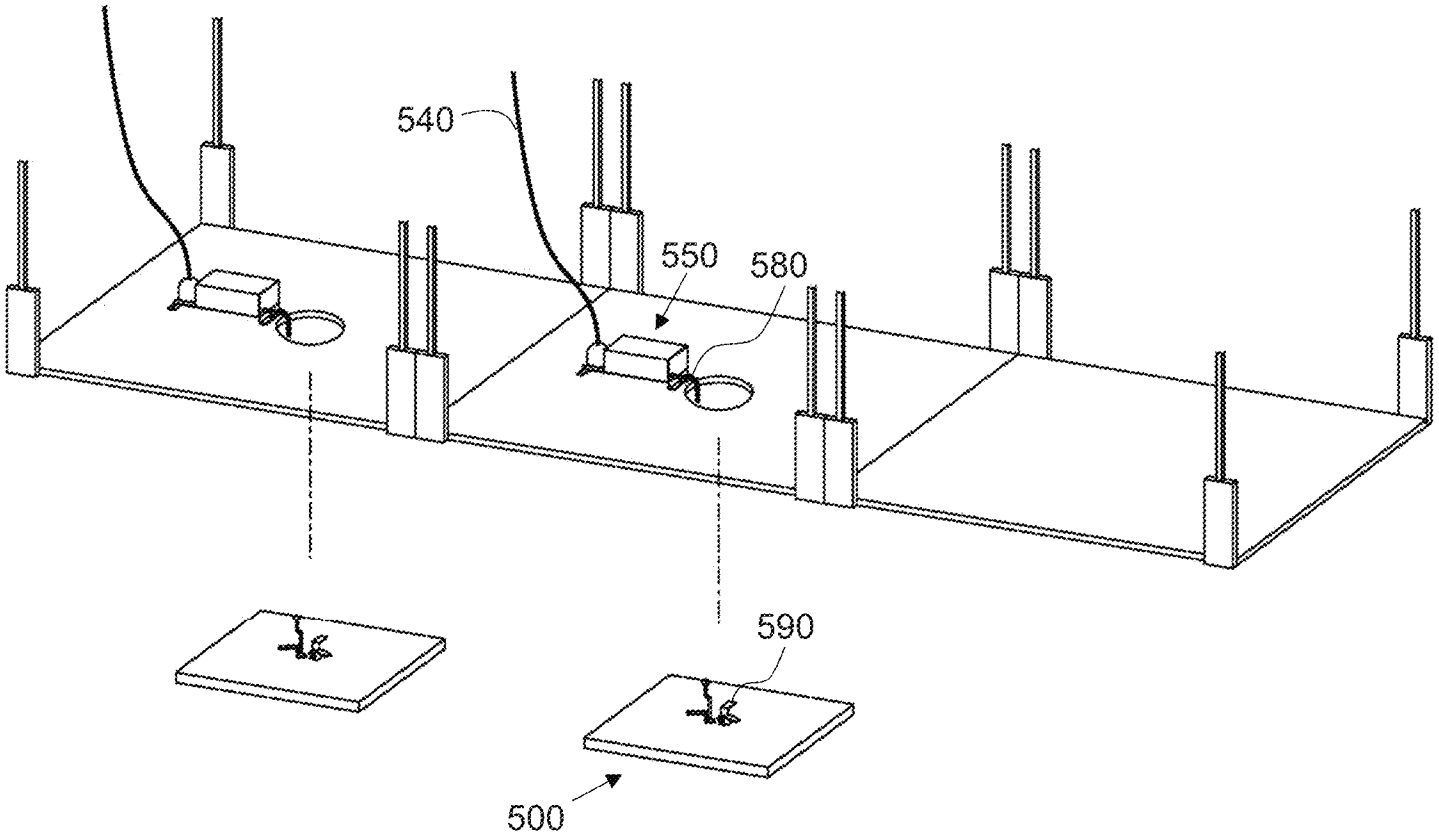
FIG. 29 is a schematic diagram for describing a method of installing a lighting appliance according to the embodiment.

As illustrated in FIG. 29, a worker present in the room space installs the power supply adapter 550 to the ceiling material 300.

The worker in the room space places the power supply adapter 550 connected to the wiring with a connector 540 on the rear of the ceiling via the opening through which the wiring with the connector 540 to be connected is passed.

The wiring with a connector 540 has a form that returns to the rear of the ceiling, and the DC harness 580 of the power supply adapter 550 has a form that protrudes into the room space from the opening.

The lighting appliance 500 is connected to the DC harness 580 and is supplied with power.

In this manner, work is performed to electrically connect the lighting appliance 500 provided in the room space below the formed ceiling 522 and the power supply adapter 550.

The lighting appliance 500 includes a fastener 590 and is attached to the ceiling 522 through the fastener 590 being passed through the opening and being hooked on the rear of the ceiling material 300.

Each fastener 63 of the lighting appliance 500 has springiness (elasticity) and penetrates through the opening of the ceiling material 300 from the ceiling surface side (the room space side).

After penetrating through the opening, the fasteners 63 are hooked on the ceiling rear surface of the ceiling material 300, and thus load is applied to the ceiling material 300.

When the lighting appliance 500 is attached to the ceiling 522, the load of one lighting appliance 500 and one power supply adapter 550 is applied to one ceiling material 300.

Note that the mounting spring 463 corresponds to one form of the fastener 590.

The fastener 63 is not limited to a structure having springiness and can be any structure that applies load to the ceiling material 300.

Figure 30:
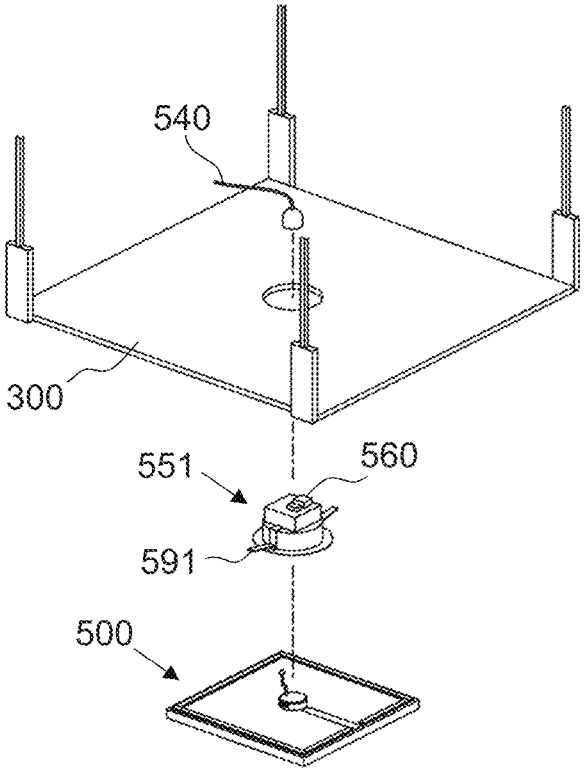
FIG. 30 is a schematic diagram for describing another example of a method of installing a lighting appliance according to a third embodiment.
Figure 31:
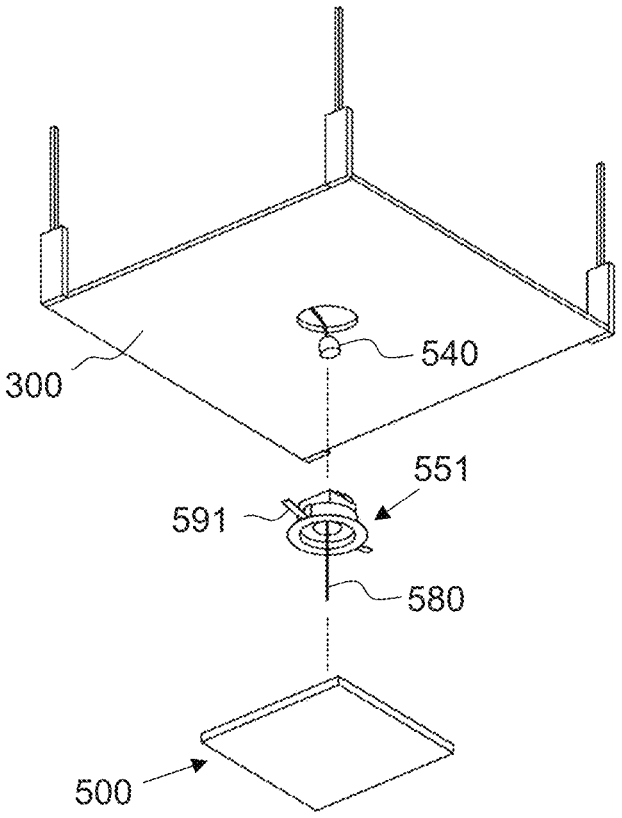
FIG. 31 is a schematic diagram for describing another example of a method of installing a lighting appliance according to the third embodiment.

As illustrated in FIGS. 30 and 31, instead of the fastener 63 of the lighting appliance 500 being attached to the opening of the ceiling material 300, a fastener 591 of a power supply adapter 551 can be attached to the opening of the ceiling material 300.

Note that either the work of connecting the wiring with the connector 540 and the power supply adapter 550, or the work of connecting the power supply adapter 550 and the lighting appliance 500 can be performed prior to the other.

The work of attaching the power supply adapter 550 to the ceiling material 300 can be performed before or after the lighting appliance 500 is connected to the power supply adapter 550.

In this way, the work of installing the lighting appliance 500 in the ceiling material 300 is performed by passing the fastener 590 of the lighting appliance 500 that is electrically connected to the wiring with a connector 540 through the opening of the ceiling material 300.

Alternatively, the work of installing the lighting appliance 500 on the ceiling material 300 is performed by passing the fastener 591 of the power supply adapter 550 that is electrically connected to the wiring with a connector 540 through the opening of the ceiling material 300.

Further, work is performed in which the wiring with a connector 540 and the power supply adapter 550 are connected by the connector of the wiring with a connector 540, and the power supply adapter 550 thus electrically connected to the wiring with a connector 540 is placed in the ceiling rear space.

In addition, work is performed in which the lighting appliance 500 is installed on the ceiling material 300.

Note that, as described in the embodiment related to the lighting appliance 100, the lighting appliance 500 can be attached to the ceiling material 300 via the mounting bracket 60 having the mounting springs 63 as a fastener.

In this case, after performing work in which the power supply adapter 550 that is electrically connected to the wiring with a connector 540 is placed in the ceiling rear space, a mounting bracket 160 is installed on the ceiling material 300 by a fastener.

The DC harness 580 of the power supply adapter 550 disposed in the ceiling rear space is drawn into the room space through the opening 64 of the mounting bracket 60, and is connected to the lighting appliance 500 in the room space such that the power supply adapter 550 and the lighting appliance 500 are electrically connected.

By electrically connecting with the power supply adapter 550, the lighting appliance 500 electrically connects with the wiring with a connector 540.

The lighting appliance 500 is installed on the mounting bracket 60 in a state in which the power supply adapter 550 and the lighting appliance 500 are electrically connected.

The claw portions 44 of the fitting adapter 40 as the mounting adapter correspond to a fastener used for installing the lighting appliance 500 on the mounting bracket 60.

In other words, a fastener of the mounting bracket 60 is used for installation to the ceiling material 300, and a fastener of the lighting appliance 500 is used for installation to the mounting bracket 60.

In this manner, the fastener of the lighting appliance 500 is passed through the opening 64 of the mounting bracket 60, and installation work of installing the lighting appliance 500 on the ceiling material 300 via the mounting bracket 60 is performed.

The mounting bracket 60 can be referred to as one form of a mounting aid member that assists installation of the lighting appliance 500 on the ceiling material 300.

The mounting aid member can have a shape and structure similar to that of, for example, the mounting bracket 60 and can be formed from a material other than metal.

As described in the embodiment related to the lighting appliance 400, the lighting appliance 500 can be moved in a state in which the lighting appliance 500 is installed on the ceiling material 300, so the position of the lighting appliance 500 with respect to the ceiling material 300 can be adjusted.

In a case in which lighting appliances 500 are disposed in a coupled manner as illustrated in FIG. 26, in a state in which each of the plurality of lighting appliances 500 coupled to each ceiling material 300 is installed, the lighting appliances 500 may be slightly displaced from intended installation positions due to misalignment of the opening of the ceiling material 300 or the like.

It is preferable that such coupled lighting be aligned in an accurate straight line from the perspective of aesthetics.

As such, after performing the work of installing adjacent lighting appliances 500 to be coupled (here, adjacent lighting appliances 500 are referred to as a first lighting appliance and a second lighting appliance, respectively) on the respective ceiling materials 300, the first lighting appliance or the second lighting appliance is moved to perform the work of adjusting the coupling between the first lighting appliance and the second lighting appliance.

Note that it is conceivable that the first lighting appliance and the second lighting appliance be installed in a coupled manner at the stage of being installed on the ceiling.

On the other hand, the coupling at this stage can be staggered further than an intended state.

Therefore, as work for coupling the lighting appliances 500 and installing the lighting appliances 500 to the ceiling, a first coupling work in which the first lighting appliance and the second lighting appliance are coupled and installed to respective ceiling materials 300, and a second coupling work in which the first lighting appliance or the second lighting appliance installed on the ceiling material 300 is moved to adjust the coupling between the first lighting appliance and the second lighting appliance after the first coupling work can be performed separately at two stages.

Note that the power supply adapter 550 is disposed near the opening through which the power supply adapter 550 itself has passed and on the rear of the ceiling material 300 having the opening.

Accordingly, in a case in which one lighting appliance 500 is attached to one ceiling material 300, one power supply adapter 550 that connects to the lighting appliance 210 is disposed on one ceiling material 300.

Therefore, similar to the first embodiment, one power supply adapter 550 and one lighting appliance 500 are the load applied to one ceiling material 300.

Note that the power supply adapter 550 can be disposed on the ceiling material 300 to which a lighting appliance 500 is not attached.

For example, the power supply adapter 550 can be moved such that the power supply adapter 550 is disposed on a ceiling material 300 that does not include an opening.

As a result, the load applied to one ceiling material 300 can be reduced.

For example, a total of two power supply adapters 550 each disposed on each of two ceiling materials 300 in FIG. 29 can be disposed on one ceiling material that does not include an opening.

However, it is also conceivable that the work of disposing a power supply adapter 550 is difficult or troublesome if the distance to the ceiling material 300 is not reachable by arm.

As described above, the installation work of the lighting appliance 500 does not include appliance with the hanging material 570, and thus it is sufficient that an opening having a size that allows for pulling out the wiring with a connector 540 on the rear of the ceiling into the room space.

In other words, in order to perform the work of installing the lighting appliance 500 on the ceiling 522, it is sufficient that an opening of a size that allows an arm to pass through is present.

On the other hand, if the lighting appliance requires work to be fixed with the hanging material 570, it becomes difficult to perform the work to attach the lighting appliance from the room space side by using only an opening of a size that allows an arm to pass through.

By providing the wiring with a connector 540 in advance on the ceiling before the installation work of the lighting appliance 500, even a person with no electric construction credentials can perform work to electrically connect the lighting appliance 500 and the wiring on the rear of the ceiling.

Therefore, a worker that opens a hole in the ceiling material 300 for installation as a part of the ceiling can perform the installation work of the lighting appliance 500 as is.

That is, in construction of the building 510, the lighting appliance supplier supplies the lighting appliance 500 to the ceiling installation worker instead of supplying the lighting appliance 500 to the electrical material company, and the ceiling installation worker can perform ceiling construction with the lighting appliance 500.

Embodiments of the present disclosure have been described above with reference to specific examples.

However, the present disclosure is not limited to these specific examples.

All embodiments that can be carried out by a person skilled in the art modifying the design as appropriate based on the embodiments described above in the present disclosure are also within the scope of the present disclosure, as long as they encompass the spirit of the present disclosure.

In addition, in the spirit of the present disclosure, a person skilled in the art can conceive of various modified examples and modifications, and it is understood that these modified examples and modifications will also fall within the scope of the present disclosure.

DENOTATION OF REFERENCE NUMERALS

10 Lighting appliance body
20 Light source module
22 Light source
23 Light emitting element
40 Fitting adapter
43 Lighting appliance side connector
50 Power supply unit
51 Electrical cable
51*a* Power supply side connector
60 Mounting bracket
100 Lighting appliance
300 Ceiling material
400 Lighting appliance
410 Lighting appliance body
411 Base plate
440 Holding member
443 Lighting appliance side connector
460 Mounting member
461 Protruding portion
463 Mounting spring
500 Certificate lighting appliance
550, 551 Power supply adapter

What is claimed is:

1. A method of mounting a lighting appliance, comprising:

fitting an annular mounting bracket into a mounting hole formed in a building material;

passing an electrical cable of a power supply unit through an inner opening of the annular mounting bracket such that a power supply side connector disposed at an end portion of the electrical cable on a front side of the building material, the power supply unit being disposed at a position that does not overlap the mounting hole on a rear side of the building material;

connecting the power supply side connector to a lighting appliance side connector fixed to an upper surface of a fitting adapter provided on a rear surface of a lighting appliance body on a side opposite to a light emitting surface of the lighting appliance body, the lighting appliance body including a plurality of light sources disposed in a region having an area dimension larger than an area dimension of the mounting hole, and a cover including a main light emitting surface facing the plurality of light sources, an area of the main light emitting surface being larger than an area of the mounting hole; and fitting the fitting adapter in which the power supply side connector is connected to the lighting appliance side connector into the inner opening of the mounting bracket fitted into the mounting hole to expose the upper surface of the fitting adapter to a space on a rear side of the building material, wherein the power supply unit is separated from the annular mounting bracket.

2. The method of mounting a lighting appliance according to claim 1, further comprising:

disposing the power supply unit on the rear side of the building material before the mounting bracket is fitted into the mounting hole of the building material.

3. The method of mounting a lighting appliance according to claim 1, wherein the area of the mounting hole is ⅓ or less than the area of the main light emitting surface of the cover.

4. A mounting structure for a lighting appliance, comprising:

a power supply unit disposed at a position that does not overlap a mounting hole on a rear side of a building material in which the mounting hole is formed;

an annular mounting bracket fitted into the mounting hole;

a lighting appliance body including a plurality of light sources disposed in a region larger than an area of the mounting hole, and a cover including a main light emitting surface facing the plurality of light sources, an area of the main light emitting surface being larger than an area of the mounting hole; and a fitting adapter provided on a rear surface of the lighting appliance body on a side opposite to a light emitting surface of the lighting appliance body, the fitting adapter including a lighting appliance side connector fixed to an upper surface of the fitting adapter, wherein a power supply side connector provided at an end portion of an electrical cable connected to the power supply unit is connected to the lighting appliance side connector, and the fitting adapter is fitted into an inner opening of the mounting bracket, and the upper surface of the fitting adapter is exposed to a space on a rear side of the building material, wherein the power supply is separated from the annular mounting bracket.

5. The mounting structure for a lighting appliance according to claim 4, wherein the plurality of light sources are also disposed in a region overlapping the fitting adapter in the lighting appliance body.

6. A lighting appliance, comprising:

a lighting appliance body including a base plate having a light source arrangement surface and a rear surface on a side opposite to the light source arrangement surface, and a plurality of light sources disposed on the light source arrangement surface;

a mounting member provided on the rear surface side of the base plate;

a mounting spring fixed to the mounting member and attached to a mounting hole formed in a building material; and a holding member fixed to the rear surface of the base plate, wherein the mounting member is sandwiched between the rear surface of the base plate and the holding member, and is movable in a direction parallel to the rear surface of the base plate.

7. The lighting appliance according to claim 6, further comprising:

a lighting appliance side connector provided on a side of the rear surface of the base plate, the lighting appliance side connector being connectable to a power supply side connector provided at an end portion of an electrical cable of a power supply unit disposed at a position not overlapping the mounting hole on a rear side of the building material.

8. A method of constructing a building, the method comprising:

providing, among a plurality of wiring disposed on a ceiling rear of a ceiling formed with a plurality of ceiling materials, wiring with a connector as wiring for electrically connecting to a lightweight large lighting appliance as a lighting appliance that is not fixed with a hanging material when installed on a ceiling;

connecting the wiring with a connector and a power supply unit by using a connector of the wiring with a connector, and disposing the power supply unit thus electrically connected to the wiring with a connector in a ceiling rear space;

installing an annular mounting bracket on the ceiling material by passing a fastener of the annular mounting bracket through an opening of the ceiling material;

drawing an electrical cable of the power supply unit disposed in the ceiling rear space into a room space through an opening of the annular mounting bracket, connecting the electrical cable to the lightweight large lighting appliance, and electrically connecting the wiring with a connector and the lightweight large lighting appliance; and passing a fastener of the lightweight large lighting appliance electrically connected to the wiring with a connector through the opening of the annular mounting bracket, and installing the lightweight large lighting appliance on the ceiling material, the lightweight large lighting appliance including a plurality of light sources disposed in a region larger than an area of the opening of the ceiling material, and a cover including a main light emitting surface facing the plurality of light sources, an area of the main light emitting surface being larger than an area of the opening of the ceiling material, wherein the power supply unit is separated from the annular mounting bracket.

9. The method according to claim 8, wherein in the disposing the power supply unit in the ceiling rear space, the connector of the wiring with a connector disposed on the ceiling rear is drawn into the room space through the opening of the ceiling material, the connector is connected to a terminal stand of the power supply unit, and then the power supply unit is disposed in the ceiling rear space.

10. The method according to claim 8, wherein in the installing the annular mounting bracket on the ceiling material, a fastener of the annular mounting bracket is passed through the opening of the ceiling material in a state in which the power supply unit and the wiring with a connector connected to the power supply unit are disposed in the ceiling rear space.

11. The method according to claim 8, wherein in the disposing the power supply unit in the ceiling rear space, the power supply unit is disposed on the ceiling material on which the lightweight large lighting appliance connected to the power supply unit is installed.

* * * * *